US009293094B2

(12) United States Patent
Morii et al.

(10) Patent No.: US 9,293,094 B2
(45) Date of Patent: Mar. 22, 2016

(54) LIQUID CRYSTAL DISPLAY DEVICE AND DRIVING METHOD THEREOF

(75) Inventors: Hideki Morii, Osaka (JP); Akihisa Iwamoto, Osaka (JP); Satoshi Horiuchi, Osaka (JP); Takayuki Mizunaga, Osaka (JP); Kazuya Nakaminami, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 125 days.

(21) Appl. No.: 14/237,677

(22) PCT Filed: Aug. 3, 2012

(86) PCT No.: PCT/JP2012/069803

§ 371 (c)(1),
(2), (4) Date: Feb. 7, 2014

(87) PCT Pub. No.: WO2013/021930

PCT Pub. Date: Feb. 14, 2013

(65) Prior Publication Data

US 2014/0191935 A1 Jul. 10, 2014

(30) Foreign Application Priority Data

Aug. 10, 2011 (JP) ..... 2011-175324

(51) Int. Cl.
*G09G 3/36* (2006.01)

(52) U.S. Cl.
CPC ..... *G09G 3/3611* (2013.01); *G09G 3/3677* (2013.01); *G09G 2330/027* (2013.01)

(58) Field of Classification Search
CPC ..... G09G 3/3677; G09G 3/3611
USPC ..... 345/92
See application file for complete search history.

(56) References Cited

U.S. PATENT DOCUMENTS

2001/0009411 A1* 7/2001 Kusanagi ..... G09G 3/3648 345/93
2010/0182305 A1* 7/2010 Fang ..... G09G 3/3677 345/212
2010/0259525 A1 10/2010 Ohkawa et al.
2011/0134090 A1 6/2011 Iwamoto et al.
2012/0218245 A1 8/2012 Morii et al.

FOREIGN PATENT DOCUMENTS

WO 2011/055584 A1 5/2011

OTHER PUBLICATIONS

Official Communication issued in International Patent Application No. PCT/JP2012/069803, mailed on Oct. 9, 2012.

* cited by examiner

*Primary Examiner* — Shaheda Abdin
(74) *Attorney, Agent, or Firm* — Keating & Bennett, LLP

(57) ABSTRACT

The invention provides a liquid crystal display device that includes an IGZO-GDM which can quickly remove a residual charge in a panel when the power supply is turned off, and a driving method of the liquid crystal display device. Each bistable circuit that configures a shift register includes a thin film transistor TI for increasing a potential of an output terminal based on a first clock, a region netA connected to a gate terminal of the thin film transistor TI, a thin film transistor TC for lowering a potential of the region netA, and a region netB connected to a gate terminal of the thin film transistor TC. In such a configuration, a power supply off sequence includes a display off sequence and a gate off sequence. The gate off sequence includes at least a gate-bus-line discharge step (t14 to t15), a netB discharge step (t15 to t16), and a netA discharge step (t16 to t17).

16 Claims, 18 Drawing Sheets

LIQUID CRYSTAL DISPLAY DEVICE AND DRIVING METHOD THEREOF

TECHNICAL FIELD

The present invention relates to a liquid crystal display device which includes a monolithic gate driver having a thin film transistor using an oxide semiconductor (IGZO) as a semiconductor layer, and a driving method of the liquid crystal display device.

BACKGROUND ART

In general, an active-matrix type liquid crystal display device includes a liquid crystal panel formed of two substrates that sandwich a liquid crystal layer in between. On one of the two substrates, there are arranged in a lattice shape a plurality of gate bus lines (scanning signal lines) and a plurality of source bus lines (video signal lines). Further, a plurality of pixel formation portions arranged in a matrix shape are provided respectively corresponding to intersections between the plurality of gate bus lines and the plurality of source bus lines. Each pixel formation portion includes a thin film transistor (TFT) as a switching element having a gate terminal connected to a gate bus line that passes through a corresponding intersection and a source terminal connected to a source bus line that passes through the intersection, and a pixel capacitor for holding a pixel value. Further, on the other substrate out of the two substrates, there is provided in some cases a common electrode as a counter electrode that is provided common to the plurality of pixel formation portions. In the active-matrix type liquid crystal display device, there are further provided a gate driver (a scanning signal line drive circuit) for driving the plurality of gate bus lines and a source driver (a video signal line drive circuit) for driving the plurality of source bus lines.

While a video signal that indicates a pixel value is transmitted by the source bus lines, each source bus line cannot transmit at one time (simultaneously) video signals that indicate pixel values of a plurality of rows. Therefore, writing of a video signal to a pixel capacitor in the pixel formation portions arranged in the matrix shape is sequentially performed for each one row. Therefore, the gate driver is configured by a shift register formed of a plurality of stages so that a plurality of gate bus lines are sequentially selected by predetermined periods.

In such a liquid crystal display device, there is a case that even after a user turned off a power supply, a display is not cleared immediately and an image like a residual image remains. This is because when the power supply of a device is turned off, a discharge path of a charge held in the pixel capacitor is cut off, and a residual charge is accumulated in the pixel formation portion. When the power supply of the device is turned on in a state that a residual charge is accumulated in the pixel formation portion, reduction of a display quality, such as occurrence of flicker due to bias of impurities based on the residual charge, occurs. Accordingly, when the power supply is turned off, for example, all gate bus lines are set in a selected state (ON state) and a black voltage is applied to the source bus line, so that the charge on the panel is discharged.

Further, concerning the liquid crystal display device, a gate driver that is made monolithic is progressed in recent years. Conventionally, in many cases, gate drivers have been mounted as an IC (Integrated Circuit) chip, on a peripheral portion of a substrate that configures a liquid crystal panel. However, in recent years, the gate drivers have gradually come to be directly formed on the substrate. Such a gate driver is called a "monolithic gate driver". Further, a panel that includes the monolithic gate driver is called a "gate driver monolithic panel".

In the gate driver monolithic panel, the above method cannot be adopted concerning the discharge of a charge on the panel. In WO 2011/055584, the invention of the following liquid crystal display device is disclosed. In a bistable circuit that configures a shift register in a gate driver, there is provided a thin film transistor that has a drain terminal connected to a gate bus line, a source terminal connected to a reference potential wiring that transmits a reference potential, and a gate terminal that is applied with a clock signal for operating the shift register. In such a configuration, when supply of a power supply voltage from outside is cut off, the thin film transistor is set in the ON state by setting a clock signal to a high level, and also, a level of the reference potential is increased from a gate-off potential to a gate-on potential. Accordingly, a potential of each gate bus line is increased to the gate-on potential, and a residual charge in all pixel formation portions is discharged.

PRIOR ART DOCUMENT

Patent Document

[Patent Document 1] WO 2011/055584

SUMMARY OF THE INVENTION

Problems to be Solved by the Invention

In recent years, development of an IGZO-TFT liquid crystal panel (a liquid crystal panel that uses IGZO as a kind of an oxide semiconductor, as a semiconductor layer of a thin film transistor) is being progressed. Also in the IGZO-TFT liquid crystal panel, development of a monolithic gate driver is being progressed. It should be noted that, hereinafter, a monolithic gate driver that is provided in the IGZO-TFT liquid crystal panel is referred to as a "IGZO-GDM". Because a-Si TFT has an unsatisfactory off-characteristic, in an a-Si TFT liquid crystal panel, a floating charge in a portion other than the pixel formation portion is discharged in a few seconds. Therefore, in the a-Si TFT liquid crystal panel, a floating charge in a portion other than the pixel formation portion does not particularly become a problem. However, IGZO-TFT has the excellent on-characteristic and off-characteristic. Because the off-characteristic when a bias voltage to the gate is 0 V (that is, when there is no bias) is markedly superior to that of a-Si TFT, a floating charge of a node connected to the TFT is not discharged via the TFT at a gate-off time. As a result, a charge remains during long hours in the circuit. According to a certain trial calculation, in the IGZO-GDM that adopts a configuration shown in FIG. 8 described later, a few hours (a few thousand seconds to a few ten thousand seconds) are required to discharge a floating charge on netA. Further, according to a BT (Bias Temperature) stress test of the IGZO-GDM, a size of a threshold shift of a IGZO-TFT becomes a few V per one hour. From the above, in the IGZO-GDM, it is understood that existence of a residual charge becomes a large cause of a threshold shift of the IGZO-TFT. For the above reason, when a shift operation stops in the middle in the shift register of the IGZO-GDM, there is a risk that a threshold shift of the TFT occurs in only a certain stage. As a result, the shift register does not operate normally, and image display is not performed on the screen.

When a gate driver is an IC chip, a TFT in the panel is only the TFT in the pixel formation portion. Therefore, when the power supply is turned off, it is sufficient to discharge a charge in the pixel formation portion and a charge on the gate bus line. However, in the case of the monolithic gate driver, a TFT also exists in the gate driver as a TFT in the panel. In the configuration shown in FIG. 8, for example, two floating nodes indicated by a reference character netA and a reference character netB exist. Therefore, in the IGZO-GDM, when the power supply is turned off, it is necessary to discharge a charge in the pixel formation portion, a charge on the gate bus line, a charge on the netA, and a charge on the netB.

Therefore, an object of the present invention is to provide a liquid crystal display device that includes an IGZO-GDM which can quickly remove a residual charge in a panel when the power supply is turned off, and a driving method of the liquid crystal display device.

Means for Solving the Problems

A first aspect of the present invention is directed to a liquid crystal display device comprising: a substrate configuring a display panel; and a plurality of switching elements formed on the substrate, in which an oxide semiconductor is used as a semiconductor layer configuring the plurality of switching elements, the liquid crystal display device comprising:

a plurality of video signal lines for transmitting a video signal;

a plurality of scanning signal lines that intersect with the plurality of video signal lines;

a plurality of pixel formation portions arranged in a matrix shape corresponding to the plurality of video signal lines and the plurality of scanning signal lines;

a scanning signal line drive circuit that includes a shift register formed of a plurality of bistable circuits that sequentially output pulses based on a clock signal, and selectively drives the plurality of scanning signal lines based on the pulses output from the shift register, the plurality of bistable circuits being provided in one-to-one correspondence with the plurality of scanning signal lines;

a power supply state detector that detects ON/OFF states of power supply provided from outside; and a drive controller that outputs the clock signal, a reference potential as a potential which becomes a reference of operations of the plurality of bistable circuits, and a clear signal for initializing states of the plurality of bistable circuits, and controls an operation of the scanning signal line drive circuit, wherein the plurality of video signal lines, the plurality of scanning signal lines, the plurality of pixel formation portions, and the scanning signal line drive circuit are formed on the substrate, each of the plurality of bistable circuits has an output-node connected to the scanning signal line, an output-node control switching element having a first electrode to which the clock signal is applied, a second electrode connected to the output-node, and a third electrode to which the reference potential is applied, an output control switching element having a second electrode to which the clock signal is applied, and a third electrode connected to the output-node, a first-node connected to a first electrode of the output control switching element, a first first-node control switching element having a second electrode connected to the first-node, and a third electrode to which the reference potential is applied, a second first-node control switching element having a first electrode to which the clear signal is applied, a second electrode connected to the first-node, and a third electrode to which the reference potential is applied, a second-node connected to a first electrode of the first first-node control switching element, and a first second-node control switching element having a first electrode to which the clock signal is applied, a second electrode connected to the second-node, and a third electrode to which the reference potential is applied, the power supply state detector applies a predetermined power supply off signal to the drive controller when the power supply state detector detects an OFF state of the power supply, and when the drive controller receives the power supply off signal, the drive controller controls an operation of the scanning signal line drive circuit so that a first discharge process of discharging a charge in the pixel formation portion is performed and thereafter controls an operation of the scanning signal line drive circuit so that a second discharge process of discharging a charge on the scanning signal line, a charge of the second-node, and a charge of the first-node is performed.

According to a second aspect of the present invention, in the first aspect of the present invention, the second discharge process includes a scanning signal line discharge process of discharging a charge on the scanning signal line, a first-node discharge process of discharging a charge of the first-node, and a second-node discharge process of discharging a charge of the second-node, the drive controller controls an operation of the scanning signal line drive circuit so as to perform a process in an order of the scanning signal line discharge process, the second-node discharge process, and the first-node discharge process, the drive controller sets the clock signal to a ground potential and sets the clear signal and the reference potential to a high level, in the scanning signal line discharge process, the drive controller sets the clear signal to a low level and sets the clock signal and the reference potential to a ground potential, in the second-node discharge process, and the drive controller sets the clear signal to a high level and sets the clock signal and the reference potential to a ground potential, in the first-node discharge process.

According to a third aspect of the present invention, in the second aspect of the present invention, the drive controller gradually changes the clock signal from a high level to a low level, in the scanning signal line discharge process.

According to a fourth aspect of the present invention, in the first aspect of the present invention, each of the plurality of bistable circuits further has a second second-node control switching element having a first electrode to which the clear signal is applied, a second electrode connected to the second-node, and a third electrode to which the reference potential is applied, and a second output-node control switching element having a first electrode to which the clear signal is applied, a second electrode connected to the output-node, and a third electrode to which the reference potential is applied, and the drive controller sets the clear signal to a high level and sets the clock signal and the reference potential to a ground potential, in the second discharge process.

According to a fifth aspect of the present invention, in the first aspect of the present invention, each of the plurality of bistable circuits further has a second second-node control switching element having a first electrode to which the clear signal is applied, a second electrode connected to the second-node, and a third electrode to which the reference potential is applied, and the drive controller controls an operation of the scanning signal line drive circuit so that a process of discharging a charge of the second-node and a charge of the first-node is performed after a process of discharging a charge on the scanning signal line is performed, in the second discharge process.

According to a sixth aspect of the present invention, in the first aspect of the present invention, each of the plurality of bistable circuits further has a second output-node control switching element having a first electrode to which the clear signal is applied, a second electrode connected to the output-node, and a third electrode to which the reference potential is applied, and the drive controller controls an operation of the scanning signal line drive circuit so that a process of discharging a charge on the scanning signal line and a charge of the first-node is performed after a process of discharging a charge of the second-node is performed, in the second discharge process.

According to a seventh aspect of the present invention, in the first aspect of the present invention, the drive controller includes a level shifter circuit that converts a signal of a low voltage into a signal of a high voltage, and the level shifter circuit includes a logic circuit unit for generating, from one clock signal, a plurality of clock signals having mutually different phases.

According to an eighth aspect of the present invention, in the first aspect of the present invention, the drive controller includes a level shifter circuit that converts a signal of a low voltage into a signal of a high voltage, the level shifter circuit is connected to a timing controller by two or more signal lines, and signals transmitted by two signal lines out of the signal lines that connect between the level shifter circuit and the timing controller are a signal by which horizontal synchronization can be detected and a signal by which vertical synchronization can be detected.

According to a ninth aspect of the present invention, in the seventh aspect of the present invention, the level shifter circuit further includes an oscillation circuit unit that outputs a basic clock, and the logic circuit unit generates the plurality of clock signals, based on the basic clock that is output from the oscillation circuit unit.

According to a tenth aspect of the present invention, in the seventh aspect of the present invention, the level shifter circuit further includes an oscillation circuit unit that outputs a basic clock, and a nonvolatile memory for generating a timing of the logic circuit unit is stored in a package IC that includes a level shifter circuit.

An eleventh aspect of the present invention is directed to a driving method of a liquid crystal display device comprising: a substrate configuring a display panel; a plurality of switching elements formed on the substrate; a plurality of video signal lines for transmitting video signals; a plurality of scanning signal lines intersecting with the plurality of video signal lines; a plurality of pixel formation portions arranged in a matrix shape corresponding to the plurality of video signal lines and the plurality of scanning signal lines; a scanning signal line drive circuit for driving the plurality of scanning signal lines; and a drive controller for controlling an operation of the scanning signal line drive circuit, in which an oxide semiconductor is used as a semiconductor layer configuring the plurality of switching elements, wherein the driving method comprises:

a power supply state detecting step of detecting ON/OFF states of power supply provided from outside; and a charge discharging step of discharging a charge in the display panel, the plurality of video signal lines, the plurality of scanning signal lines, the plurality of pixel formation portions, and the scanning signal line drive circuit are formed on the substrate, the scanning signal line drive circuit includes a shift register formed of a plurality of bistable circuits which are provided in one-to-one correspondence with the plurality of scanning signal lines, the plurality of bistable circuits sequentially outputting pulses based on a clock signal, the drive controller outputs the clock signal, a reference potential as a potential that becomes a reference of operations of the plurality of bistable circuits, and a clear signal for initializing states of the plurality of bistable circuits, each of the plurality of bistable circuits has an output-node connected to the scanning signal line, an output-node control switching element having a first electrode to which the clock signal is applied, a second electrode connected to the output-node, and a third electrode to which the reference potential is applied, an output control switching element having a second electrode to which the clock signal is applied, and a third electrode connected to the output-node, a first-node connected to a first electrode of the output control switching element, a first first-node control switching element having a second electrode connected to the first-node, and a third electrode to which the reference potential is applied, a second first-node control switching element having a first electrode to which the clear signal is applied, a second electrode connected to the first-node, and a third electrode to which the reference potential is applied, a second-node connected to a first electrode of the first first-node control switching element, and a first second-node control switching element having a first electrode to which the clock signal is applied, a second electrode connected to the second-node, and a third electrode to which the reference potential is applied, the charge discharging step includes a first discharge step of discharging a charge in the pixel formation portion, and a second discharge step of discharging a charge on the scanning signal line, a charge of the second-node, and a charge of the first-node, and the charge discharging step is executed when the OFF state of the power supply is detected in the power supply state detecting step.

According to a twelfth aspect of the present invention, in the eleventh aspect of the present invention, the second discharge step includes a scanning-signal-line discharge step of discharging a charge on the scanning signal line, a first-node discharge step of discharging a charge of the first-node, and a second-node discharge step of discharging a charge of the second-node, the drive controller controls an operation of the scanning signal line drive circuit so as to perform a process in an order of the scanning-signal-line discharge step, the second-node discharge step, and the first-node discharge step, in the scanning-signal-line discharge step, the clock signal is set to a ground potential, and the clear signal and the reference potential are set to a high level, in the second-node discharge step, the clear signal is set to a low level, and the clock signal and the reference potential are set to a ground potential, and in the first-node discharge step, the clear signal is set to a high level, and the clock signal and the reference potential are set to a ground potential.

According to a thirteenth aspect of the present invention, in the twelfth aspect of the present invention, in the scanning-signal-line discharge step, the clock signal gradually changes from a high level to a low level.

According to a fourteenth aspect of the present invention, in the eleventh aspect of the present invention, each of the plurality of bistable circuits further has a second second-node control switching element having a first electrode to which the clear signal is applied, a second electrode connected to the second-node, and a third electrode to which the reference potential is applied, and a second output-node control switching element having a first electrode to which the clear signal is applied, a second electrode connected to the output-node, and a third electrode to which the reference potential is applied, and in the second discharge step, the clear signal is set to a high level, and the clock signal and the reference potential are set to a ground potential.

According to a fifteenth aspect of the present invention, in the eleventh aspect of the present invention, each of the plurality of bistable circuits further has a second second-node control switching element having a first electrode to which the clear signal is applied, a second electrode connected to the second-node, and a third electrode to which the reference potential is applied, and in the second discharge step, after a process of discharging a charge on the scanning signal line is performed, a process of discharging a charge of the second-node and a charge of the first-node is performed.

According to a sixteenth aspect of the present invention, in the eleventh aspect of the present invention, each of the plurality of bistable circuits further has a second output-node control switching element having a first electrode to which the clear signal is applied, a second electrode connected to the output-node, and a third electrode to which the reference potential is applied, and in the second discharge step, after a process of discharging a charge of the second-node is performed, a process of discharging a charge on the scanning signal line and a charge of the first-node is performed.

Effects of the Invention

According to a first aspect of the present invention, in the liquid crystal display device that includes the IGZO-GDM, when supply of the power supply voltage PW is cut off, a charge in the pixel formation portion is first discharged, and thereafter, a charge on the scanning signal line, and charges on the first-node and the second-node in the bistable circuit which configures the shift register are discharged. Accordingly, a residual charge in the panel is quickly removed when the power supply is turned off, and occurrence of display failure and operation failure due to existence of a residual charge in the panel is suppressed.

According to a second aspect of the present invention, in the scanning signal line discharge process, the output control switching element becomes in the ON state with the clock signal being at the ground potential. As for the output control switching element, the clock signal is applied to the second electrode and the third electrode is connected to the output-node. Therefore, a charge on the scanning signal line is discharged. Further, in the second-node discharge process, the first second-node control switching element becomes in the ON state with the reference potential being at the ground potential. As for the first second-node control switching element, the second electrode is connected to the second-node and the reference potential is applied to the third electrode. Therefore, the a charge of the second-node is discharged. Further, in the first-node discharge process, the second first-node control switching element becomes in the ON state with the reference potential being at the ground potential. As for the second first-node control switching element, the second electrode is connected to the first-node and the reference potential is applied to the third electrode. Therefore, a charge of the first-node is discharged. In the manner as described above, when the power supply is turned off, a charge of each node in the panel is sequentially quickly removed.

According to a third aspect of the present invention, in the scanning signal line discharge process, the potentials of the scanning signal lines gently decrease. Therefore, in each pixel formation portion, reduction of the pixel electrode potential due to the influence of the lead-in voltage can be suppressed.

According to a fourth aspect of the present invention, by the clear signal becoming at a high level in the second discharge process, the second first-node control switching element, the second second-node control switching element, and the second output-node control switching element become in the ON state. As for the second first-node control switching element, the second electrode is connected to the first-node and the reference potential is applied to the third electrode. As for the second second-node control switching element, the second electrode is connected to the second-node and the reference potential is applied to the third electrode. As for the second output-node control switching element, the second electrode is connected to the output-node and the reference potential is applied to the third electrode. Further, in the second discharge process, the reference potential is set to the ground potential. From the above, in the second discharge process, the charge of the first-node, the charge of the second-node, and the charge on the scanning signal line are discharged in one step.

According to a fifth aspect of the present invention, in the second discharge process, the charge of the first-node, the charge of the second-node, and the charge on the scanning signal line are discharged in a smaller number of steps as compared with the first aspect of the present invention.

According to a sixth aspect of the present invention, in the second discharge process, the charge of the first-node, the charge of the second-node, and the charge on the scanning signal line are discharged in a smaller number of steps as compared with the first aspect of the present invention.

According to a seventh aspect of the present invention, the number of input signals that are necessary to be applied to the level shifter circuit becomes smaller than that in the conventional case. As a result, cost reduction and small package become possible.

According to an eighth aspect of the present invention, the number of input signals that are necessary to be applied to the level shifter circuit becomes smaller than that in the conventional case, in a manner similar to that in the seventh aspect of the present invention. As a result, cost reduction and small package become possible.

According to a ninth aspect of the present invention, it becomes possible to realize a complex power supply off sequence relatively easily.

According to a tenth aspect of the present invention, it becomes possible to realize a complex power supply off sequence relatively easily, in a similar manner to that in the ninth aspect of the present invention.

According to an eleventh aspect of the present invention, it becomes possible to obtain an effect similar to that of the first aspect of the present invention, in the invention of the driving method of a liquid crystal display device.

According to a twelfth aspect of the present invention, it becomes possible to obtain an effect similar to that of the second aspect of the present invention, in the invention of the driving method of a liquid crystal display device.

According to a thirteenth aspect of the present invention, it becomes possible to obtain an effect similar to that of the third aspect of the present invention, in the invention of the driving method of a liquid crystal display device.

According to a fourteenth aspect of the present invention, it becomes possible to obtain an effect similar to that of the fourth aspect of the present invention, in the invention of the driving method of a liquid crystal display device.

According to a fifteenth aspect of the present invention, it becomes possible to obtain an effect similar to that of the fifth aspect of the present invention, in the invention of the driving method of a liquid crystal display device.

According to a sixteenth aspect of the present invention, it becomes possible to obtain an effect similar to that of the sixth aspect of the present invention, in the invention of the driving method of a liquid crystal display device.

MODES FOR CARRYING OUT THE INVENTION

Embodiments of the present invention are described below with reference to the appended drawings. It should be noted that, in the following description, a gate terminal (gate electrode) of a thin film transistor corresponds to a first electrode, a drain terminal (drain electrode) of the thin film transistor corresponds to a second electrode, and a source terminal (source electrode) of the thin film transistor corresponds to a third electrode. In the description, it is assumed that thin film transistors that are provided in the bistable circuit are all n-channel type thin film transistors.

1. First Embodiment

1. 1 Overall Configuration and Operation

Figure 2:
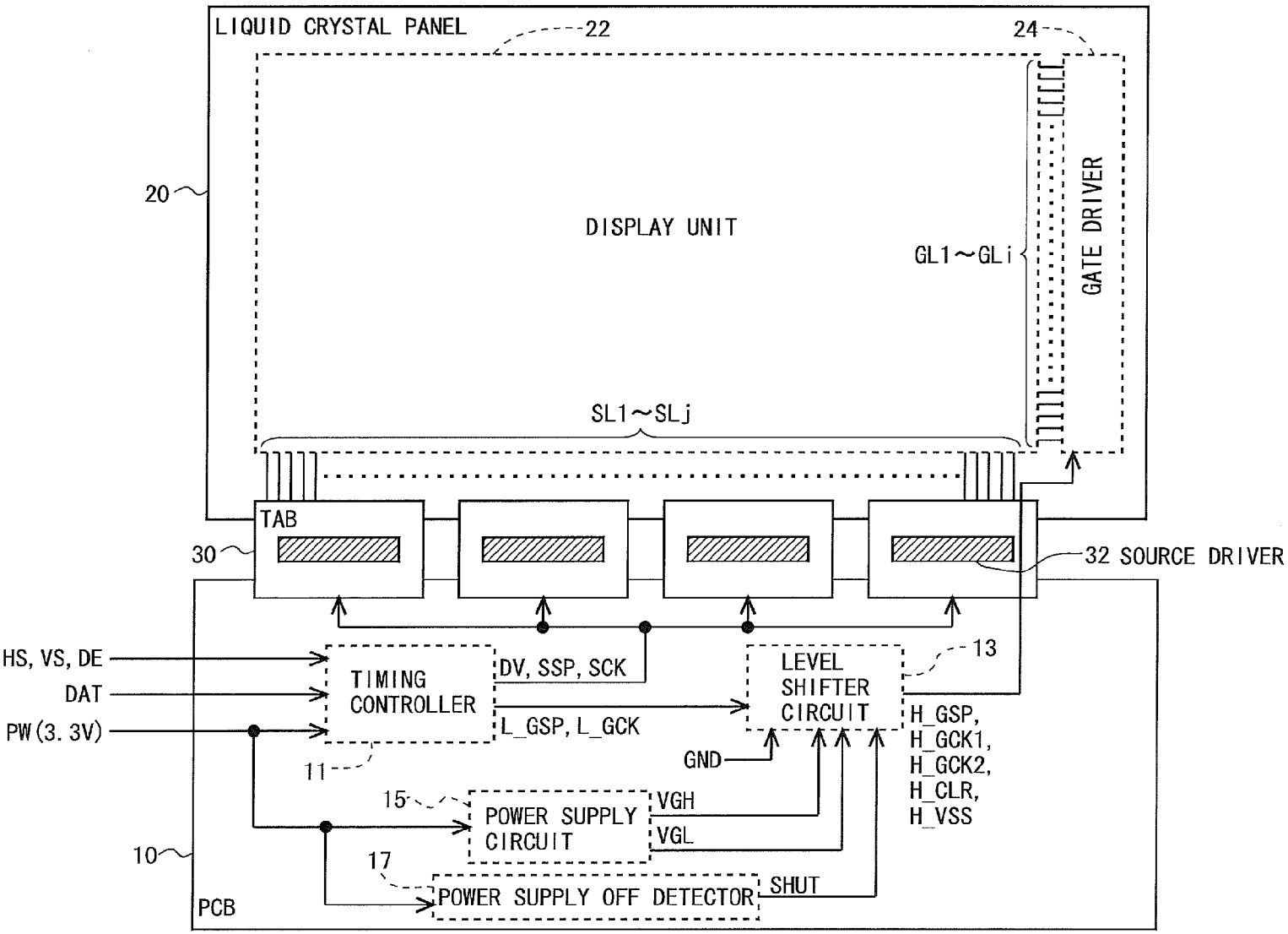
FIG. 2 is a block diagram showing an overall configuration of the liquid crystal display device in the first embodiment.

FIG. 2 is a block diagram showing an overall configuration of an active-matrix type liquid crystal display device according to a first embodiment of the present invention. As shown in FIG. 2, the liquid crystal display device is configured by a liquid crystal panel (display panel) 20, a PCB (printed circuit board) 10, and a TAB (Tape Automated Bonding) 30 connected to the liquid crystal panel 20 and the PCB 10. It should be noted that the liquid crystal panel 20 is an IGZO-TFT liquid crystal panel. The TAB 30 is in a mounting form adopted mainly in a medium-type to large-type liquid crystal panel. In a small-type to medium-type liquid crystal panel, a COG mounting may be adopted as a mounting form of a source driver. Further, recently, a system driver configuration in which a source driver 32, a timing controller 11, a power supply circuit 15, a power supply off detector 17, and a level shifter circuit 13 are set in one chip has come to be used gradually.

Figure 3:
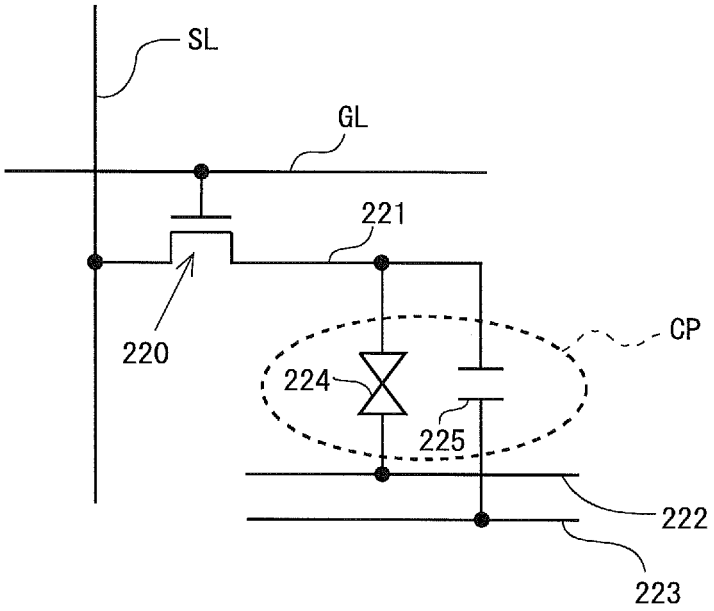
FIG. 3 is a circuit diagram showing a configuration of a pixel formation portion in the first embodiment.

The liquid crystal panel 20 is formed of opposite two substrates (these are representatively glass substrates, but are not limited to the glass substrates), and a display unit 22 for displaying an image is formed in a predetermined region on the substrates. The display unit includes a plurality of (j) source bus lines (video signal lines) SL1 to SLj, a plurality of (i) gate bus lines (scanning signal lines) GL1 to GLi, and a plurality of (i×j) pixel formation portions that are provided respectively at intersections between the source bus lines SL1 to SLj and the gate bus lines GL1 to GLi. FIG. 3 is a circuit diagram showing a configuration of the pixel formation portion. As shown in FIG. 3, each pixel formation portion includes a thin film transistor (TFT) 220 having a gate terminal connected to a gate bus line GL that passes through a corresponding intersection and a source terminal connected to a source bus line SL that passes through the intersection, a pixel electrode 221 that is connected to a drain terminal of the thin film transistor 220, a common electrode 222 and an auxiliary capacitor electrode 223 that are provided common to the plurality of pixel formation portions, a liquid crystal capacitor 224 that is formed by the pixel electrode 221 and the common electrode 222, and a auxiliary capacitor 225 that is formed by the pixel electrode 221 and the auxiliary capacitor electrode 223. Further, a pixel capacitor CP is formed by the liquid crystal capacitor 224 and the auxiliary capacitor 225. Based on a video signal that the source terminal of the thin film transistor 220 receives from the source bus line SL when the gate terminal of thin film transistor 220 receives an active scanning signal from the gate bus line GL, a voltage that indicates a pixel value is held in the pixel capacitor CP.

In the liquid crystal panel 20, there is also formed a gate driver 24 for driving the gate bus lines GL1 to GLi, as shown in FIG. 2. The gate driver 24 is the above described IGZO-GDM, and is monolithically formed on the substrate that configures the liquid crystal panel 20. On the TAB 30, a source driver 32 for driving the source bus lines SL1 to SLj is mounted in a state of an IC chip. On the PCB 10, there are provided a timing controller 11, a level shifter circuit 13, a power supply circuit 15, and a power supply off detector 17. It should be noted that, in FIG. 2, the gate driver 24 is arranged at only one side of the display unit 22. However, there are many users who request a symmetrical frame panel. In order to meet this request, a structure of arranging the gate driver 24 at both right and left sides of the display unit 22 is often used.

To this liquid crystal display device, timing signals such as a horizontal synchronization signal HS, a vertical synchronization signal VS, and a data enable signal DE, an image signal DAT and a power supply voltage PW are applied from outside. The power supply voltage PW is applied to the timing controller 11, the power supply circuit 15, and the power supply off detector 17. In the present embodiment, the power supply voltage PW is 3.3 V. However, the power supply voltage PW is not limited to 3.3 V. The input signal is not limited to the above configuration either. The timing signal and the video data are also transferred in many cases by using differential interfaces of LVDS, mipi, a DP signal, and, eDP.

The power supply circuit 15 generates a gate-on potential VGH for setting a gate bus line to a selected state, and a gate-off potential VGL for setting a gate bus line to an unselected state, based on the power supply voltage PW. In the present description, it is assumed that a source-driver positive power supply configuration is employed and the gate-on potential VGH is +20 V and the gate-off potential VGL is −10 V. However, recently, there is also a case that an output voltage of a source driver is output in an equal size at a plus side and a minus side based on a ground potential GND. In this case, a potential configuration is slightly minus-biased from a positive power supply configuration in such a way that "the gate-on potential VGH is +15 V, and the gate-off potential VGL is −V". The gate-on potential VGH and the gate-off potential VGL are applied to the level shifter circuit 13. The power supply off detector 17 outputs a power supply state signal SHUT that indicates a supply state of the power supply voltage PW (ON/OFF states of the power supply). The power supply state signal SHUT is applied to the level shifter circuit 13.

The timing controller 11 receives the timing signals such as the horizontal synchronization signal HS, the vertical synchronization signal VS, and the data enable signal DE, the image signal DAT and the power supply voltage PW, and generates a digital video signal DV, a source start pulse signal SSP, a source clock signal SCK, a gate start pulse signal L_GSP, and a gate clock signal L_GCK. The digital video signal DV, the source start pulse signal SSP, and the source clock signal SCK are applied to the source driver 32, and the gate start pulse signal L_GSP and the gate clock signal L_GCK are applied to the level shifter circuit 13. It should be noted that, concerning the gate start pulse signal L_GSP and the gate clock signal L_GCK, a potential at a high level side is set to the power supply voltage (3.3 V) PW, and a potential at a low level side is set to the ground potential (0 V) GND.

Figure 4:
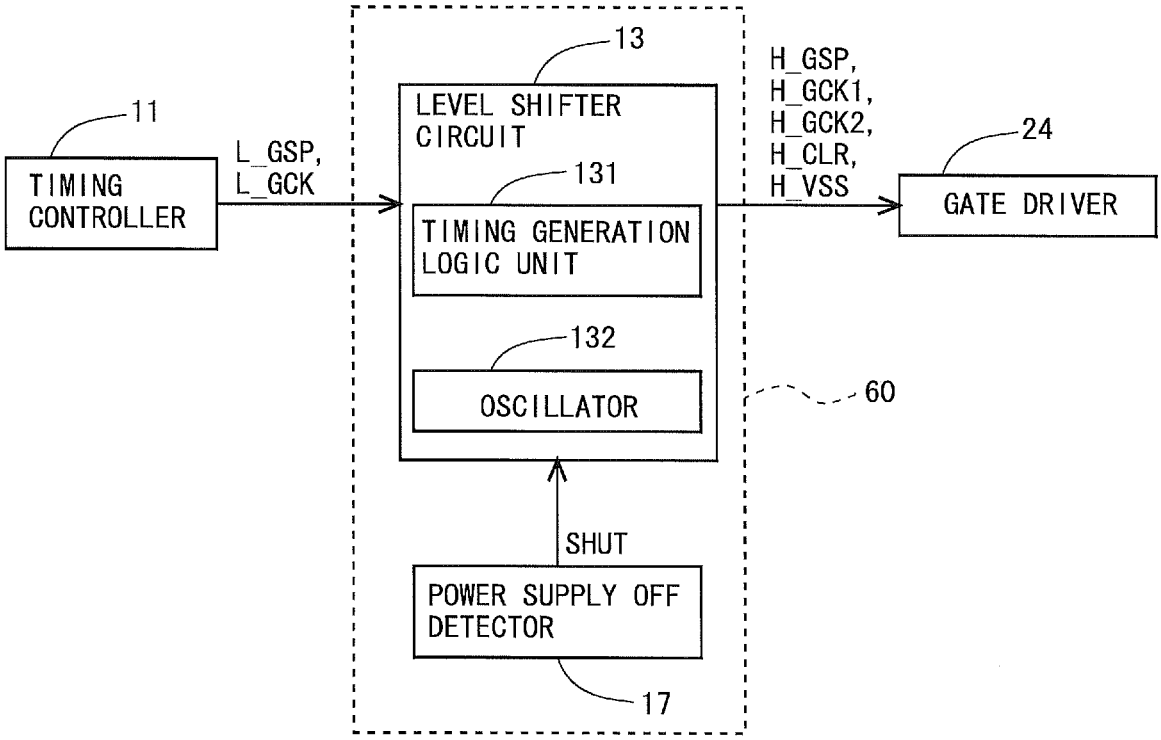
FIG. 4 is a block diagram showing a configuration of a level shifter circuit in the first embodiment.

The level shifter circuit 13 generates a signal H_GSP that is obtained by level conversion of a signal obtained by converting a gate start pulse signal L_GSP output from the timing controller 11 into a timing signal optimized for driving the IGZO-GDM, generates a first gate clock signal H_GCK1 and a second gate clock signal H_GCK2 that are based on the gate clock signal L_GCK output from the timing controller 11, and generates a reference potential H_VSS and a clear signal H_CLR that are based on an internal signal, by using the ground potential GND, and the gate-on potential VGH and the gate-off potential VGL applied from the power supply circuit 15. Then, the gate start pulse signal H_GSP, the first gate clock signal H_GCK1, the second gate clock signal H_GCK2, the clear signal H_CLR, and the reference potential H_VSS are output from the level shifter circuit 13 to the gate driver 24. It should be noted that, during the normal operation, the gate start pulse signal H_GSP, the first gate clock signal H_GCK1, the second gate clock signal H_GCK2, and the clear signal H_CLR are set equal to the gate-on potential VGH (+20V) or the gate-off potential VGL (−10V), and the reference potential H_VSS is set equal to the gate-off potential VGL (−10V). By the way, in the present embodiment, as shown in FIG. 4, the level shifter circuit 13 includes a timing generation logic unit 131 and an oscillator 132, and the configuration is such that the power supply state signal SHUT that is output from the power supply off detector 17 is applied to the level shifter circuit 13. By such a configuration, the level shifter circuit 13 can change potentials of the various signals in accordance with a predetermined timing. The predetermined timing is generated based on a nonvolatile memory in an IC that configures the level shifter circuit 13 and a register value at which data is loaded from the nonvolatile memory. It should be noted that the level shifter circuit 13 is described in further detail later.

The source driver 32 receives the digital video signal DV, the source start pulse signal SSP, and the source clock signal SCK that are output from the timing controller 11, and applies to the source bus lines SL1 to SLj a video signal for driving.

The gate driver 24 repeats application of the active scanning signal to the gate bus lines GL1 to GLi, using one vertical scanning period as a cycle, based on the gate start pulse signal H_GSP, the first gate clock signal H_GCK1, the second gate clock signal H_GCK2, the clear signal H_CLR, and the reference potential H_VSS that are output from the level shifter circuit 13. It should be noted that the gate driver 24 is described in detail later.

In the manner as described above, the video signal for driving is applied to the source bus lines SL1 to SLj, and the scanning signal is applied to the gate bus lines GL1 to GLi, so that an image based on the image signal DAT transmitted from outside is displayed in the display unit 22.

It should be noted that, in the present embodiment, a power supply state detector is realized by the power supply off detector 17, and a drive controller is realized by the timing controller 11 and the level shifter circuit 13. Further, a logic circuit unit is realized by the timing generation logic unit 131, and an oscillation circuit unit is realized by the oscillator 132.

1. 2 Configuration and Operation of a Gate Driver

Figure 5:
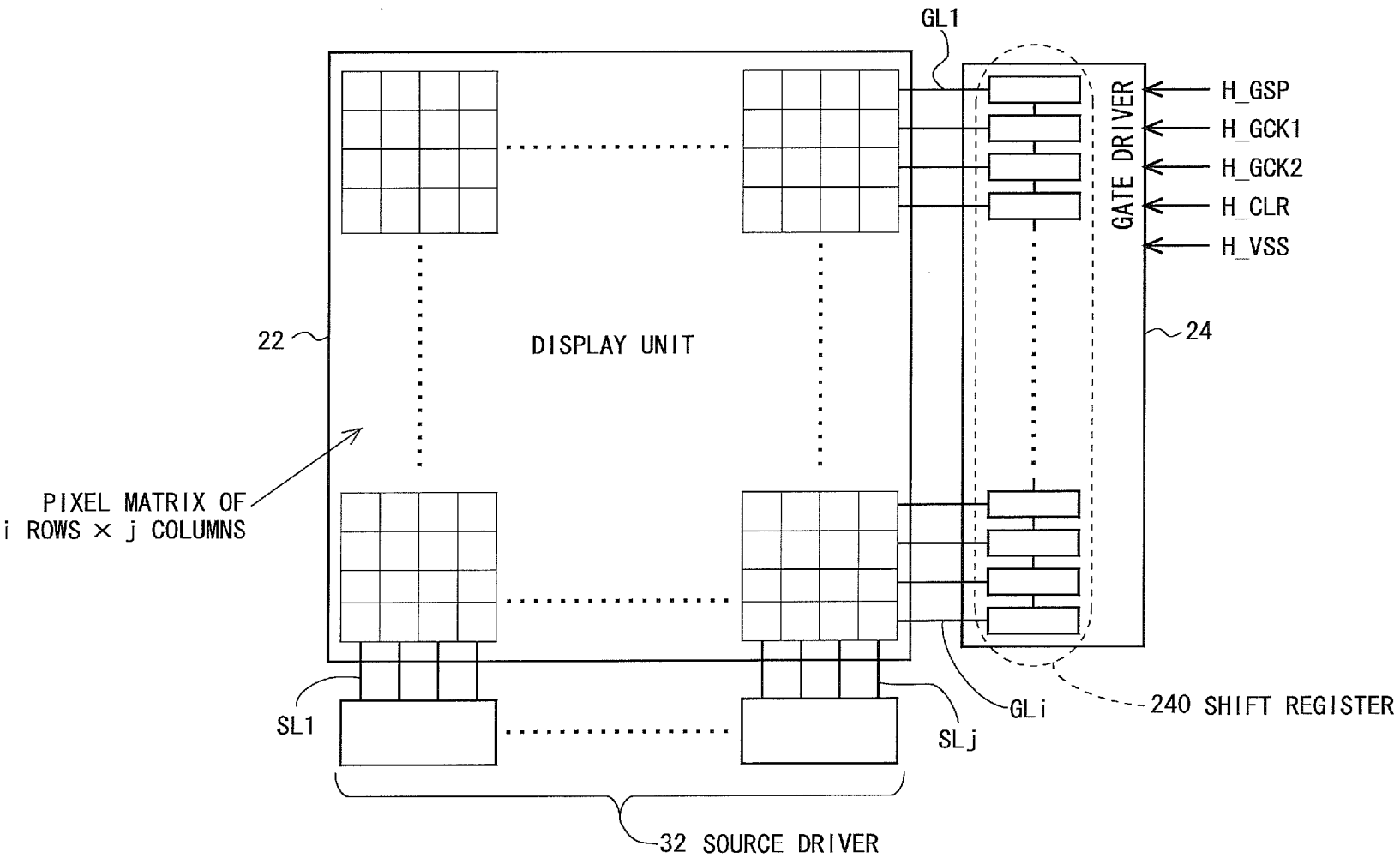
FIG. 5 is a block diagram for explaining a configuration of a gate driver in the first embodiment.

Next, a configuration and the operation of the gate driver 24 in the present embodiment are described. As shown in FIG. 5, the gate driver 24 is configured by a shift register 240 formed of a plurality of stages. In the display unit 22, a pixel matrix of i rows×j columns is formed. Stages of the shift register 240 are provided in one-to-one correspondence with rows of the pixel matrix. Each stage of the shift register 240 is a bistable circuit that is in either one of two states at each time point and outputs a signal indicative of the state (hereinafter, a "state signal"). It should be noted that the state signal that is output from each stage of the shift register 240 is applied to a corresponding gate bus line as a scanning signal.

Figure 6:
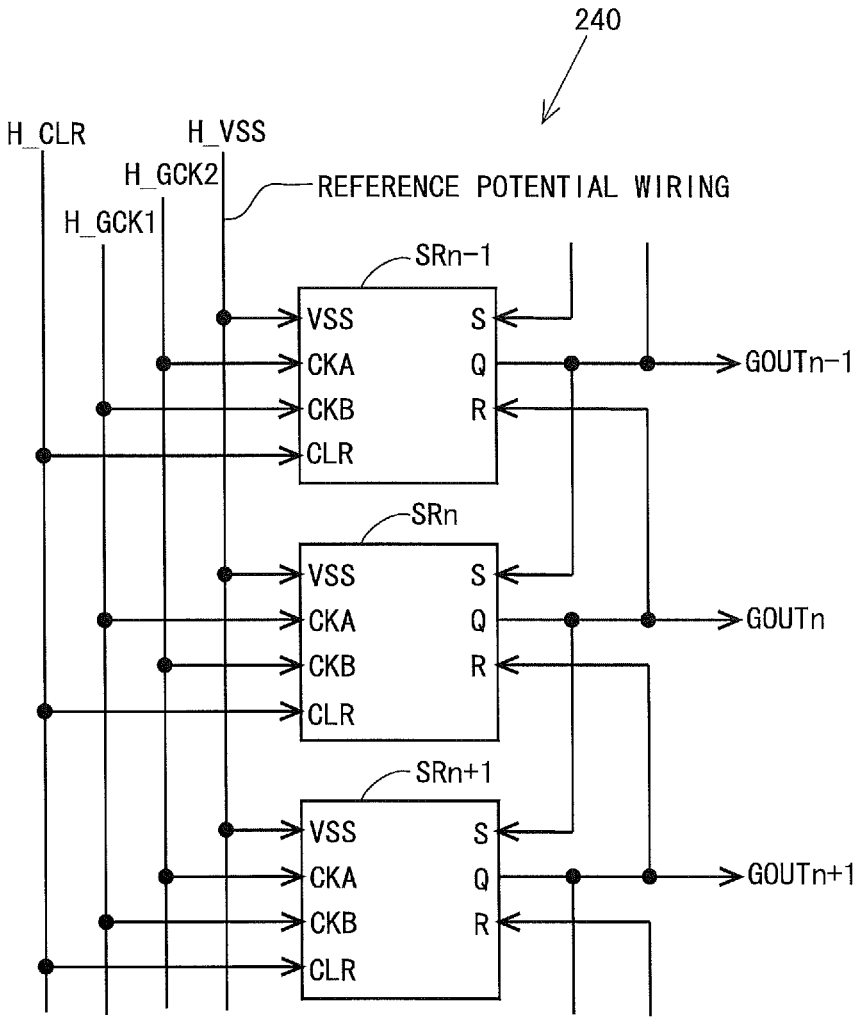
FIG. 6 is a block diagram showing a configuration of a shift register in the gate driver in the first embodiment.

FIG. 6 is a block diagram showing a configuration of the shift register 240 in the gate driver 24. It should be noted that FIG. 6 shows configurations of bistable circuits SRn−1, SRn, and SRn+1 in (n−1)-th stage, n-th stage, and (n+1)-th stage of the shift register 240. Each bistable circuit is provided with input terminals for receiving a reference potential VSS, a first clock CKA, a second clock CKB, a set signal S, a reset signal R, and a clear signal CLR, and an output terminal for outputting a state signal Q. In the present embodiment, the reference potential H_VSS that is output from the level shifter circuit 13 is applied as the reference potential VSS, and the clear signal H_CLR that is output from the level shifter circuit 13 is applied as the clear signal CLR. One of the first gate clock signal H_GCK1 and the second gate clock signal H_GCK2 that are output from the level shifter circuit 13 is applied as the first clock CKA and the other is applied as the second clock CKB. The state signal Q that is output from the preceding stage is applied as the set signal S, and the state signal Q that is output from the next stage is applied as the reset signal R. That is, when the n-th stage is focused, a scanning signal GOUTn−1 that is applied to a gate bus line of the (n−1)-th row is applied as the set signal S, and a scanning signal GOUTn+1 that is applied to a gate bus line of the (n+1)-th row is applied as the reset signal R. It should be noted that the gate start pulse signal H_GSP that is output from the level shifter circuit 13 is applied to a bistable circuit SR1 of a first stage of the shift register 240 as the set signal S.

Figure 7:
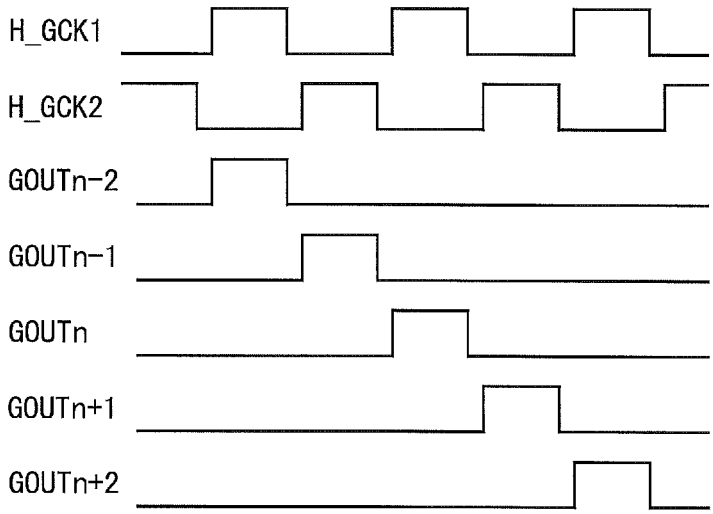
FIG. 7 is a signal waveform diagram for explaining the operation of the gate driver in the first embodiment.

In the above configuration, when a pulse of the gate start pulse signal H_GSP as the set signal S is applied to the first stage of the shift register 240, a pulse that is included in the gate start pulse signal H_GSP (this pulse is included in the state signal Q output from each stage) is sequentially transferred from the first stage to the i-th stage, based on the first gate clock signal H_GCK1 and the second gate clock signal H_GCK2 (see FIG. 7) each having on-duty set to a value around 50 percent. Corresponding to this transfer of the pulse, the state signal Q that is output from each stage sequentially becomes at a high level. Then, the state signal Q that is output from each stage is applied to the gate bus lines GL1 to GLi as scanning signals GOUT1 to GOUTi, respectively. As a result, as shown in FIG. 7, the scanning signals GOUT1 to GOUTi that sequentially become at high levels in each required period are applied to the gate bus lines GL1 to GLi in the display unit 22.

1. 3 Configuration and Operation of a Bistable Circuit

Figure 8:
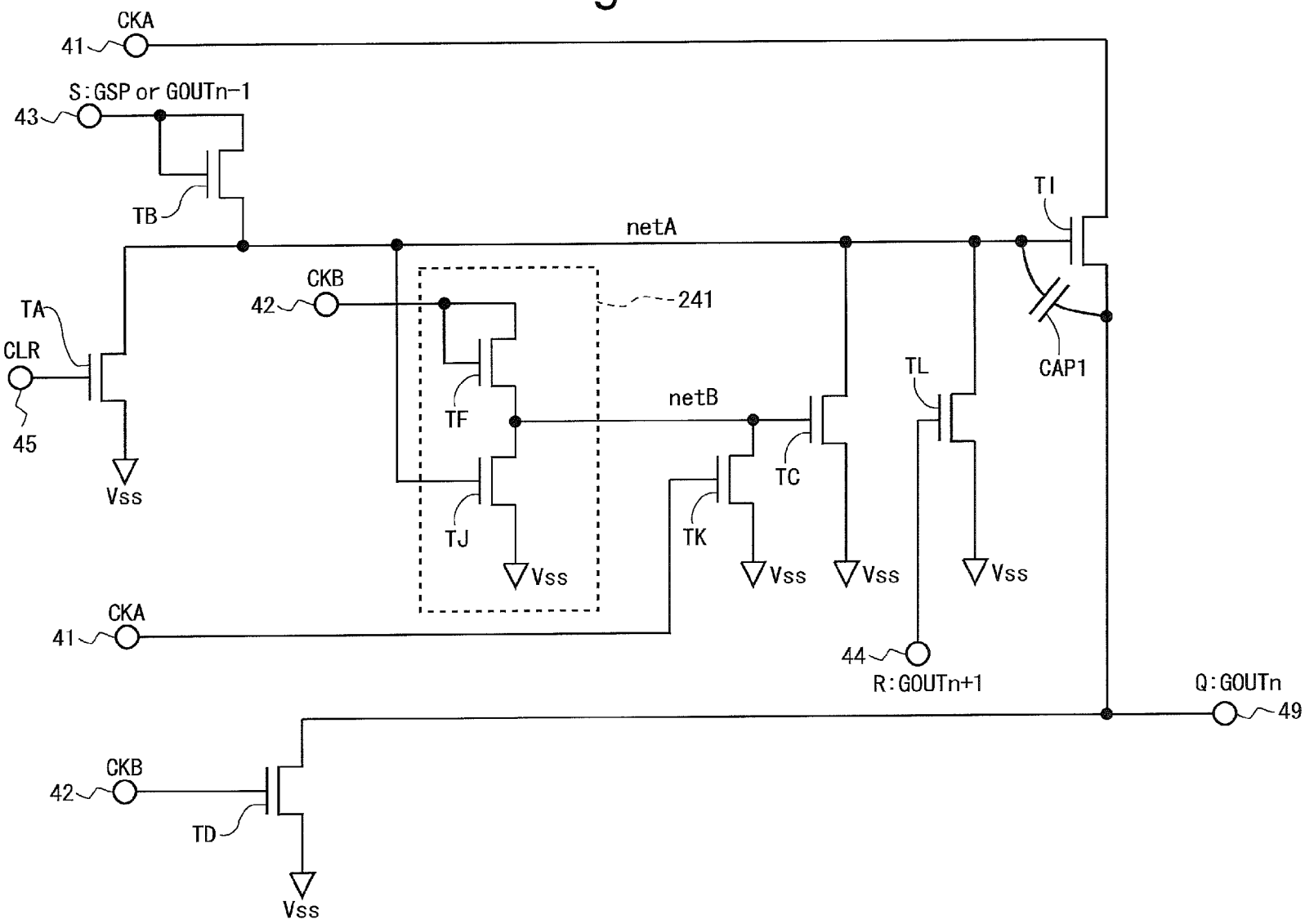
FIG. 8 is a circuit diagram showing a configuration of a bistable circuit included in a shift register in the first embodiment.

FIG. 8 is a circuit diagram showing a configuration of a bistable circuit included in the shift register 240 (a configuration of the n-th stage of the shift register 240). As shown in FIG. 8, the bistable circuit SRn includes nine thin film transistors TA, TB, TC, TD, TF, TI, TJ, TK and TL, and one capacitor CAP1. It should be noted that, in FIG. 8, an input terminal for receiving the first clock CKA is attached with a reference character 41, an input terminal for receiving the second clock CKB is attached with a reference character 42, an input terminal for receiving the set signal S is attached with a reference character 43, an input terminal for receiving the reset signal R is attached with a reference character 44, an input terminal for receiving the clear signal CLR is attached with a reference character 45, and an output terminal for outputting the state signal Q is attached with a reference character 49.

The drain terminal of the thin film transistor TA, the source terminal of the thin film transistor TB, the drain terminal of the thin film transistor TC, the gate terminal of the thin film transistor TI, the gate terminal of the thin film transistor TJ, the drain terminal of the thin film transistor TL, and one end of the capacitor CAP1 are connected to each other. It should be noted that a region (wiring) in which these are connected to each other is referred to as "netA" for convenience sake. The gate terminal of the thin film transistor TC, the source terminal of the thin film transistor TF, the drain terminal of the thin film transistor TJ, and the drain terminal of the thin film transistor TK are connected to each other. It should be noted that a region (wiring) in which these are connected to each other is referred to as "netB" for convenience sake.

Concerning the thin film transistor TA, the gate terminal is connected to the input terminal 45, the drain terminal is connected to the netA, and the source terminal is connected to the reference potential wiring. Concerning the thin film transistor TB, the gate terminal and the drain terminal are connected to the input terminal 43 (that is, in diode connection), and the source terminal is connected to the netA. Concerning the thin film transistor TC, the gate terminal is connected to the netB, the drain terminal is connected to the netA, and the source terminal is connected to the reference potential wiring. Concerning the thin film transistor TD, the gate terminal is connected to the input terminal 42, the drain terminal is connected to the output terminal 49, and the source terminal is connected to the reference potential wiring. Concerning the thin film transistor TF, the gate terminal and the drain terminal are connected to the input terminal 42 (that is, in diode connection), and the source terminal is connected to the netB. Concerning the thin film transistor TI, the gate terminal is connected to the netA, the drain terminal is connected to the input terminal 41, and the source terminal is connected to the output terminal 49. Concerning the thin film transistor TJ, the gate terminal is connected to the netA, the drain terminal is connected to the netB, and the source terminal is connected to the reference potential wiring. Concerning the thin film transistor TK, the gate terminal is connected to the input terminal 41, the drain terminal is connected to the netB, and the source terminal is connected to the reference potential wiring. Concerning the thin film transistor TL, the gate terminal is connected to the input terminal 44, the drain terminal is connected to the netA, and the source terminal is connected to the reference potential wiring. Concerning the capacitor CAP1, one end is connected to the netA, and the other end is connected to the output terminal 49. In the above configuration, by the circuit of the portion indicated by a reference character 241 in FIG. 8, an AND circuit that receives, as input signals, the second clock CKB and a logically inverted signal of a signal indicating a potential of the netA is configured.

It should be noted that, in the present embodiment, the first-node is realized by the netA, the second-node is realized by the netB, and the output-node is realized by the output terminal 49. An output control switching element is realized by the thin film transistor TI, an output-node control switching element is realized by the thin film transistor TD, a first first-node control switching element is realized by the thin film transistor TC, a second first-node control switching element is realized by the thin film transistor TA, and a first second-node control switching element is realized by the thin film transistor TK.

Figure 9:
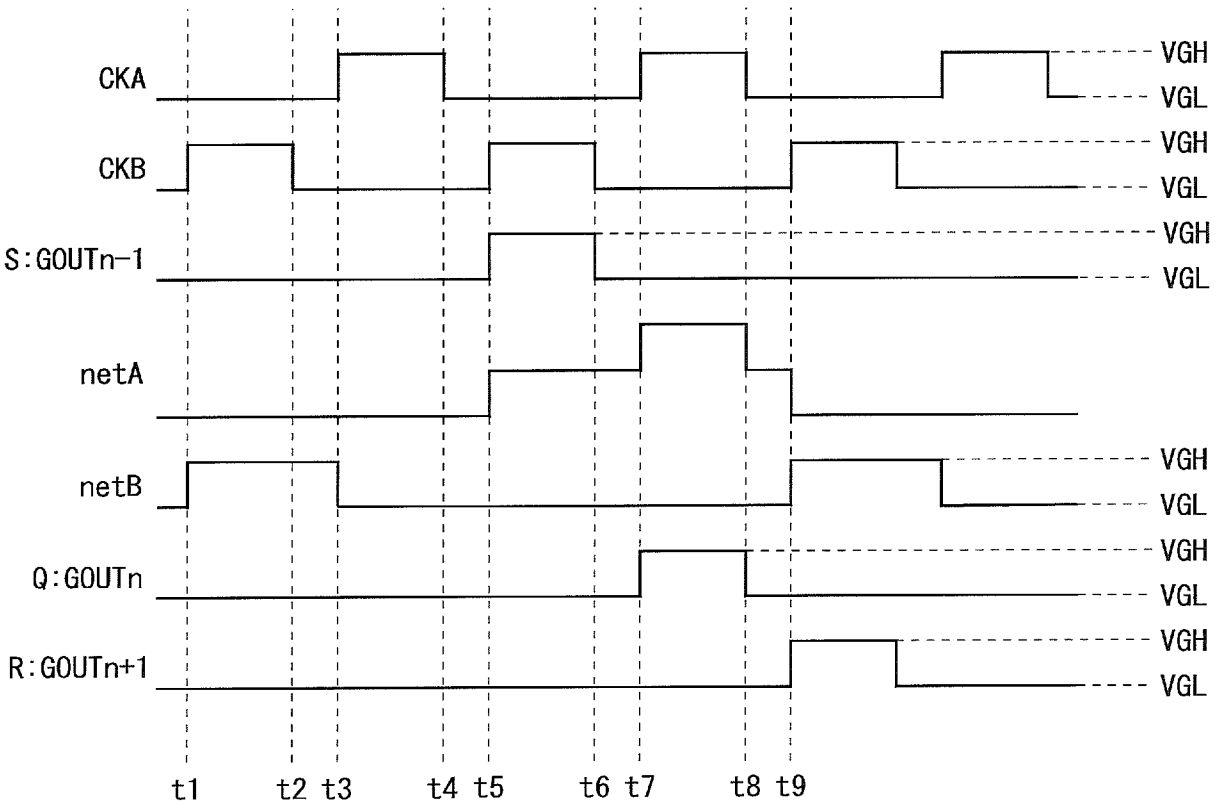
FIG. 9 is a signal waveform diagram for explaining the operation of the bistable circuit in the first embodiment.

Next, the operation of the bistable circuit SRn when the power supply voltage PW is normally supplied from outside is described with reference to FIG. 8 and FIG. 9. During a period when the liquid crystal display device is operating, the first clock CKA and the second clock CKB each having on-duty set to a value around 50 percent are applied to the bistable circuit SRn. It should be noted that, concerning the first clock CKA and the second clock CKB, a potential at a high level side is the gate-on potential VGH, and a potential at a low level side is the gate-off potential VGL.

At a time point t1, when the second clock CKB changes from the low level to the high level, the thin film transistor TF becomes in the ON state because the thin film transistor TF is in diode connection as shown in FIG. 8. At this time, because a potential of the netA is at the low level, the thin film transistor TJ is in the OFF state. Accordingly, at the time point t1, a potential of the netB changes from the low level to the high level. As a result, the thin film transistor TC becomes in the ON state, and a potential of the netA is led to the reference potential VSS. Further, at the time point t1, the thin film transistor TD also becomes in the ON state. Accordingly, a potential of the output terminal 49 (a potential of the state signal Q) is led to the reference potential VSS.

At time point t3 after the second clock CKB changes from the high level to the low level at the time point t2, the first clock CKA changes from the low level to the high level. Accordingly, the thin film transistor TK becomes in the ON state. As a result, a potential of the netB changes from the high level to the low level. It should be noted that, at the time point t3, because a potential of the netA is at the low level, the thin film transistor TI is in the OFF state. Therefore, a potential of the output terminal 49 is maintained at the low level.

At time point t5 after the first clock CKA changes from the high level to the low level at the time point t4, the set signal S changes from the low level to the high level. Because the thin film transistor TB is in diode connection as shown in FIG. 8, by the set signal S becoming at the high level, the thin film transistor TB becomes in the ON state. Accordingly, the capacitor CAP1 is charged, and a potential of the netA changes from the low level to the high level. As a result, the thin film transistor TI becomes in the ON state. In this case, during a period from the time point t5 to the time point t7, the first clock CKA is at the low level. Accordingly, during this period, the output terminal 49 is maintained at the low level. Further, during this period, the thin film transistor TL is maintained in the OFF state since the reset signal R is at the low level, and the thin film transistor TC is maintained in the OFF state since a potential of the netB is at the low level. Accordingly, a potential of the netA does not decrease during this period.

At time point t7 after the set signal S changes from the high level to the low level at the time point t6, the first clock CKA changes from the low level to the high level. In this case, because the thin film transistor TI is in the ON state, a potential of the output terminal 49 increases together with the increase of a potential of the input terminal 41. In this case, because the capacitor CAP1 is provided between the netA and the output terminal as shown in FIG. 8, a potential of the netA also increases (the netA is boot-strapped) together with the increase of a potential of the output terminal 49. A potential of the netA ideally increases to a potential of two times of the gate-on potential VGH. As a result, a large voltage is applied to the gate terminal of the thin film transistor TI, and a potential of the output terminal 49 increases to a potential of the high level of the first clock CKA, that is, the gate-on potential VGH. Accordingly, a gate bus line that is connected to the output terminal 49 of this bistable circuit SRn becomes in a selected state. It should be noted that, during a period from the time point t7 to the time point t8, because the second clock CKB is at the low level, the thin film transistor TD is maintained in the OFF state. Therefore, a potential of the output terminal 49 does not decrease during this period. During the period from the time point t7 to the time point t8, the thin film transistor TL is maintained in the OFF state since the reset signal R is at the low level, and the thin film transistor TC is maintained in the OFF state since a potential of the netB is at the low level. Accordingly, a potential of the netA does not decrease during this period.

At a time point t8, the first clock CKA changes from the high level to the low level. Accordingly, a potential of the output terminal 49, that is, a potential of the state signal Q decreases together with the decrease of a potential of the input terminal 41. Accordingly, a potential of the netA decreases via the capacitor CAP1. At time point t9, the reset signal R changes from the low level to the high level. Accordingly, the thin film transistor TL becomes in the ON state. As a result, a potential of the netA becomes at the low level. Further, at the time point t9, the second clock CKB changes from the low level to the high level. Accordingly, the thin film transistor TD becomes in the ON state. As a result, a potential of the state signal Q becomes at the low level.

By the above operation performing in each bistable circuit in the shift register 240, the scanning signals GOUT1 to GOUTi that sequentially become at high levels in each required period are applied to the gate bus lines GL1 to GLi in the display unit 22.

1. 4 Operation when the Power Supply is Cut Off

Next, the operation of the liquid crystal display device when supply of the power supply voltage PW from outside is cut off is described with reference to FIGS. 1, 2 and 8. It should be noted that a series of this processing is referred to as a "power supply off sequence".

Figure 1:
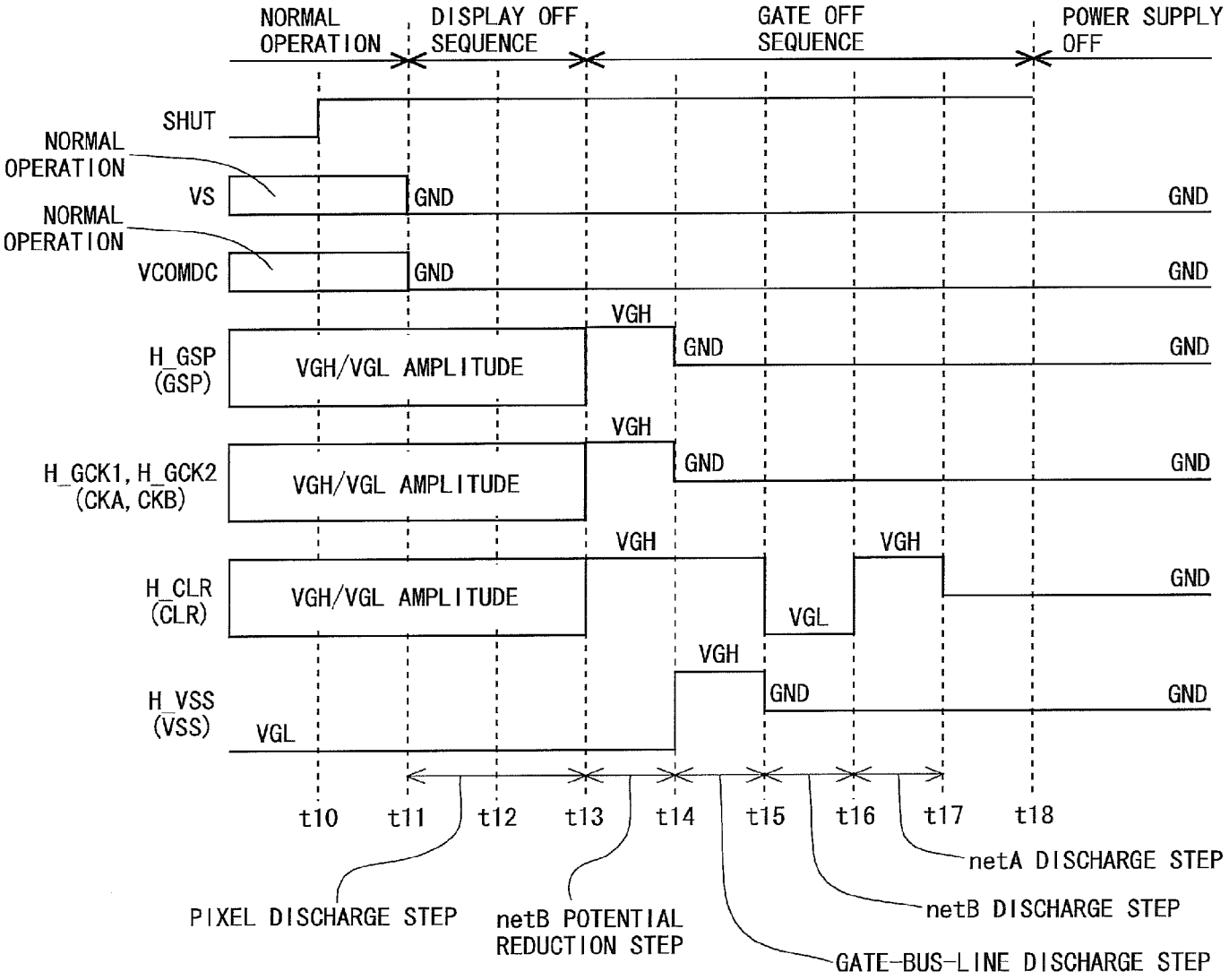
FIG. 1 is a signal waveform diagram for explaining the operation when the power supply is cut off in an active-matrix type liquid crystal display device according to a first embodiment of the present invention.

FIG. 1 shows waveforms of the power supply state signal SHUT, the video signal potential (a potential of the source bus line SL) VS, a common electrode potential VCOMDC, the gate start pulse signal H_GSP, the gate clock signals (the first gate clock signal H_GCK1 and the second gate clock signal H_GCK2), the clear signal H_CLR, and the reference potential H_VSS. As described above, the gate start pulse signal H_GSP is applied to the first-stage bistable circuit of the shift register 240 as the set signal S, the gate clock signals (the first gate clock signal H_GCK1 and the second gate clock signal H_GCK2) are applied to the bistable circuits as the first clock CKA and the second clock CKB, the clear signal H_CLR is applied to each bistable circuit as the clear signal CLR, and the standard potential H_VSS is applied to each bistable circuit as the reference potential VSS.

In FIG. 1, a period described as "DISPLAY OFF SEQUENCE" is a period for discharging a charge in the pixel formation portion, and a period described as "GATE OFF SEQUENCE" is a period for discharging a charge in the gate driver 24. The power supply off sequence includes the display off sequence and the gate off sequence. It should be noted that, in the present description, it is assumed that the power supply voltage PW is normally supplied before a time point t10 and that the supply of the power supply voltage PW is cut off at the time point t10.

During the period when the power supply voltage PW is normally supplied (during the period before the time point t10), the power supply state signal SHUT is maintained at the low level. During this period, the gate start pulse signal H_GSP, the gate clock signals (the first gate clock signal H_GCK1 and the second gate clock signal H_GCK2), and the clear signal H_CLR are set at the gate-on potential VGH or the gate-off potential VGL, and the reference potential H_VSS is set at the gate-off potential VGL.

When the supply of the power supply voltage PW is cut off at the time point t10, the power supply off detector 17 changes the power supply state signal SHUT from the low level to the high level. At the time point t11 after a predetermined time is passed since the time point when the power supply state signal SHUT changed from the low level to the high level, a period of the display off sequence starts. In the present embodiment, during this period, the video signal potential VS and the common electrode potential VCOMDC are set equal to the ground potential GND (0 V), with the gate start pulse signal H_GSP, the gate clock signals (the first gate clock signal H_GCK1 and the second gate clock signal H_GCK2), and the clear signal H_CLR being set in waveforms similar to those during the normal operation time. Accordingly, by taking one vertical scanning period, a charge in the pixel formation portion in the display unit 22 is discharged. Hereinafter, a processing step that is performed in the display off sequence is referred to as a "pixel discharge step".

At a time point t13, a period of the gate off sequence starts. During the period from the time point t13 to a time point t14, the gate start pulse signal H_GSP, the gate clock signals (the first gate clock signal H_GCK1 and the second gate clock signal H_GCK2), and the clear signal H_CLR are set at the gate-on potential VGH, and the reference potential H_VSS is set at the gate-off potential VGL. Accordingly, because the thin film transistor TK becomes in the ON state by the first clock CKA becoming at the high level, a potential of the netB becomes at the low level. Hereinafter, a processing step that is performed during the period from the time point t13 to the time point t14 in the gate off sequence is referred to as a "netB potential reduction step".

During a period from the time point t14 to a time point t15, the gate start pulse signal H_GSP and the gate clock signals (the first gate clock signal H_GCK1 and the second gate clock signal H_GCK2) are set to the ground potential GND, and the clear signal H_CLR and the reference potential H_VSS are set to the gate-on potential VGH. Accordingly, because the clear signal CLR becomes at the high level, the thin film transistor TA becomes in the ON state. Because the reference potential VSS is set equal to the gate-on potential VGH in this state, a potential of the netA becomes a potential lower than the gate-on potential VGH by a threshold voltage Vth. Accordingly, the thin film transistor TI becomes in the ON state. Further, during this period, a potential of the first clock CKA becomes the ground potential GND. As a result, a charge in each gate bus line in the display unit 22 is discharged. As described above, the period from the time point t14 to the time point t15 becomes a period for discharging a charge on the gate bus line. Hereinafter, a processing step that is performed during the period from the time point t14 to the time point t15 in the gate off sequence is referred to as a "gate-bus-line discharge step".

During a period from the time point t15 to a time point t16, the clear signal H_CLR is set to the gate-off potential VGL, and the gate start pulse signal H_GSP, the gate clock signals (the first gate clock signal H_GCK1 and the second gate clock signal H_GCK2), and the reference potential H_VSS are set to the ground potential GND. Accordingly, the reference potential VSS becomes 0 V. However, because the clear signal CLR becomes at the low level, the thin film transistor TA becomes in the OFF state. Therefore, a potential of the netA is maintained at the high level. Accordingly, the thin film transistor TJ becomes in the ON state. Consequently, a potential of the netB becomes the ground potential GND. As described above, the period from the time point t15 to the time point t16 becomes a period for discharging a charge on the netB. Hereinafter, a processing step that is performed during the period from the time point t15 to the time point t16 in the gate off sequence is referred to as a "netB discharge step".

During a period from the time point t16 to a time point t17, the clear signal H_CLR is set to the gate-on potential VGH, and the gate start pulse signal H_GSP, the gate clock signals (the first gate clock signal H_GCK1 and the second gate clock signal H_GCK2), and the reference potential H_VSS are set to the ground potential GND. Accordingly, with the reference potential VSS being set to the ground potential GND, the thin film transistor TA becomes in the ON state. Accordingly, a potential of the netA becomes the ground potential GND. As described above, the period from the time point t16 to the time point t17 becomes a period for discharging a charge on the netA. Hereinafter, a processing step that is performed during the period from the time point t16 to the time point t17 in the gate off sequence is referred to as a "netA discharge step".

During the period from the time point t17 to the time point t18, the gate start pulse signal H_GSP, the gate clock signals (the first gate clock signal H_GCK1 and the second gate clock signal H_GCK2), the clear signal H_CLR, and the reference potential H_VSS are set to the ground potential GND. Thus, the gate off sequence is ended.

It should be noted that, in the present embodiment, a charge discharging step is realized by steps performed during the period of the display off sequence and the gate off sequence. A first discharge step is realized by the pixel discharge step, and a second discharge step is realized by steps performed during the period of the gate off sequence. A scanning-signal-line discharge step is realized by the gate-bus-line discharge step, a first-node discharge step is realized by the netA discharge step, and a second-node discharge step is realized by the netB discharge step. Further, a power supply off signal is realized by the power supply state signal SHUT that is set to the high level.

In order to be able to change the potentials of various signals in a plurality of steps as shown in FIG. 1 in the gate off sequence, the level shifter circuit 13 includes a timing generation logic unit 131 and an oscillator 132 as shown in FIG. 4. In such a configuration, when the power supply state signal SHUT that is applied from the power supply off detector 17 to the level shifter circuit 13 changes from the low level to the high level, the timing generation logic unit 131 obtains a start timing of each step by counting a basic clock generated by the oscillator 132 by using a counter. The timing generation logic unit 131 changes the potentials of the various signals to predetermined potentials, in accordance with the timings. In the manner as described above, there are generated the gate start pulse signal H_GSP, the gate clock signals (the first gate clock signal H_GCK1 and the second gate clock signal H_GCK2), the clear signal H_CLR, and the reference potential H_VSS, each of which has the waveform as shown in FIG. 1. It should be noted that the level shifter circuit 13 and the power supply off detector 17 may be stored in one LSI as shown by a reference character 60 in FIG. 4.

1. 5 Effects

According to the present embodiment, in the liquid crystal display device that includes the IGZO-GDM, the level shifter circuit 13 that supplies various signals to the gate driver 24 includes the timing generation logic unit 131 and the oscillator 132. When supply of the power supply voltage PW is cut off, the timing generation logic unit 131 obtains a start timing of each step for the power supply off sequence. The level shifter circuit 13 changes the potentials of the various signals, in accordance with the timings obtained by the timing generation logic unit 131. Therefore, a plurality of processes can be easily performed in the power supply off sequence. By changing the potentials of the various signals as described above (see FIG. 1) by the level shifter circuit 13, the power supply off sequence that includes the pixel discharge step, the netB potential reduction step, the gate-bus-line discharge step, the netB discharge step, and the netA discharge step is performed. Accordingly, in a liquid crystal display device including an IGZO-GDM, when the supply of the power supply voltage PW is cut off, a charge in the pixel formation portion, a charge on the gate bus line, a charge on the netB, and a charge on the netA are sequentially discharged. In the manner as described above, a liquid crystal display device including an IGZO-GDM capable of quickly removing a residual charge in the panel when the power supply is turned off can be realized. As a result, in the liquid crystal display device including an IGZO-GDM, occurrence of display failure and operation failure due to existence of a residual charge in the panel is suppressed.

1. 6 Modifications 1. 6. 1 About the Display Off Sequence

Figure 10:
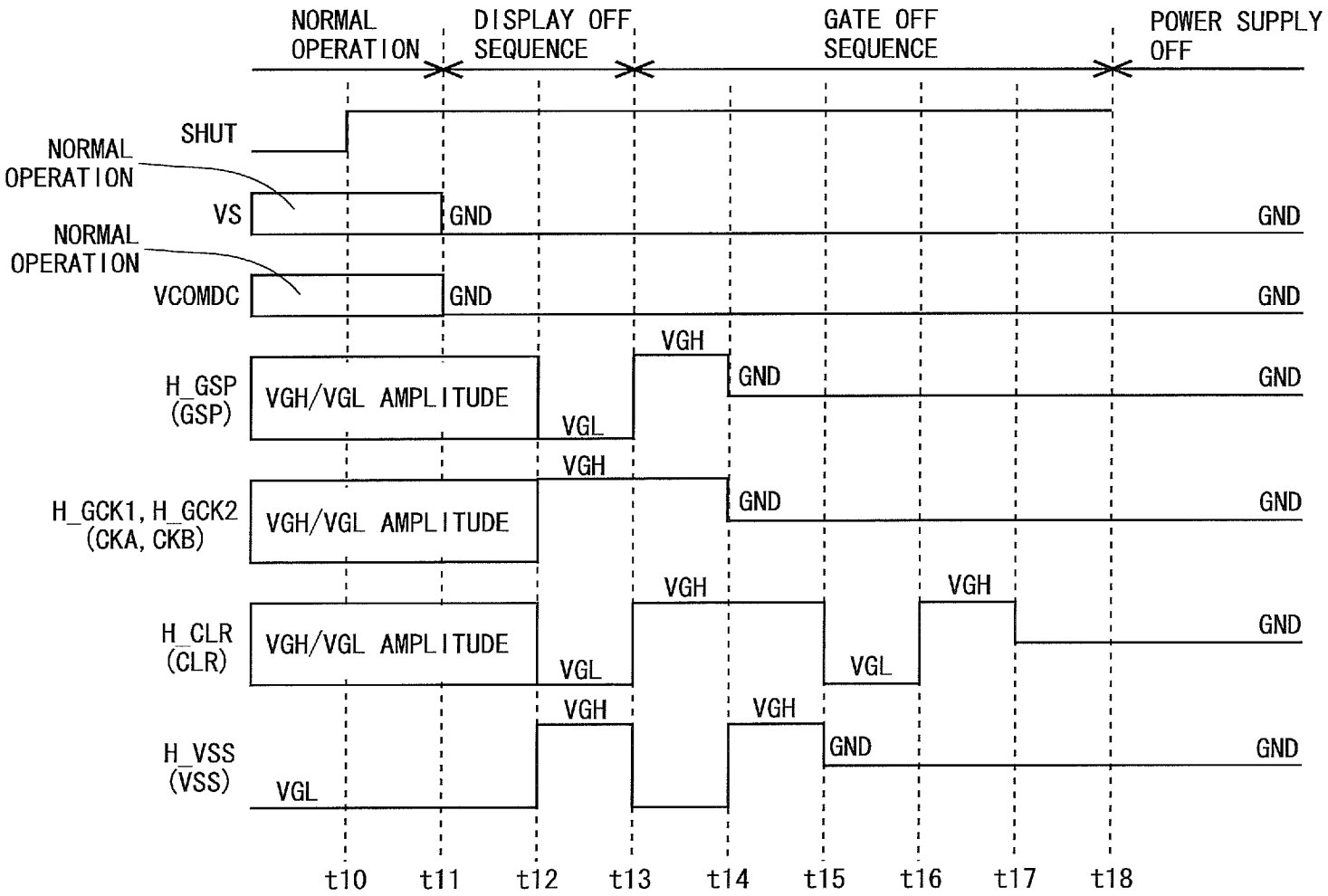
FIG. 10 is a signal waveform diagram for explaining a modification of the first embodiment concerning a display off sequence.
Figure 11:
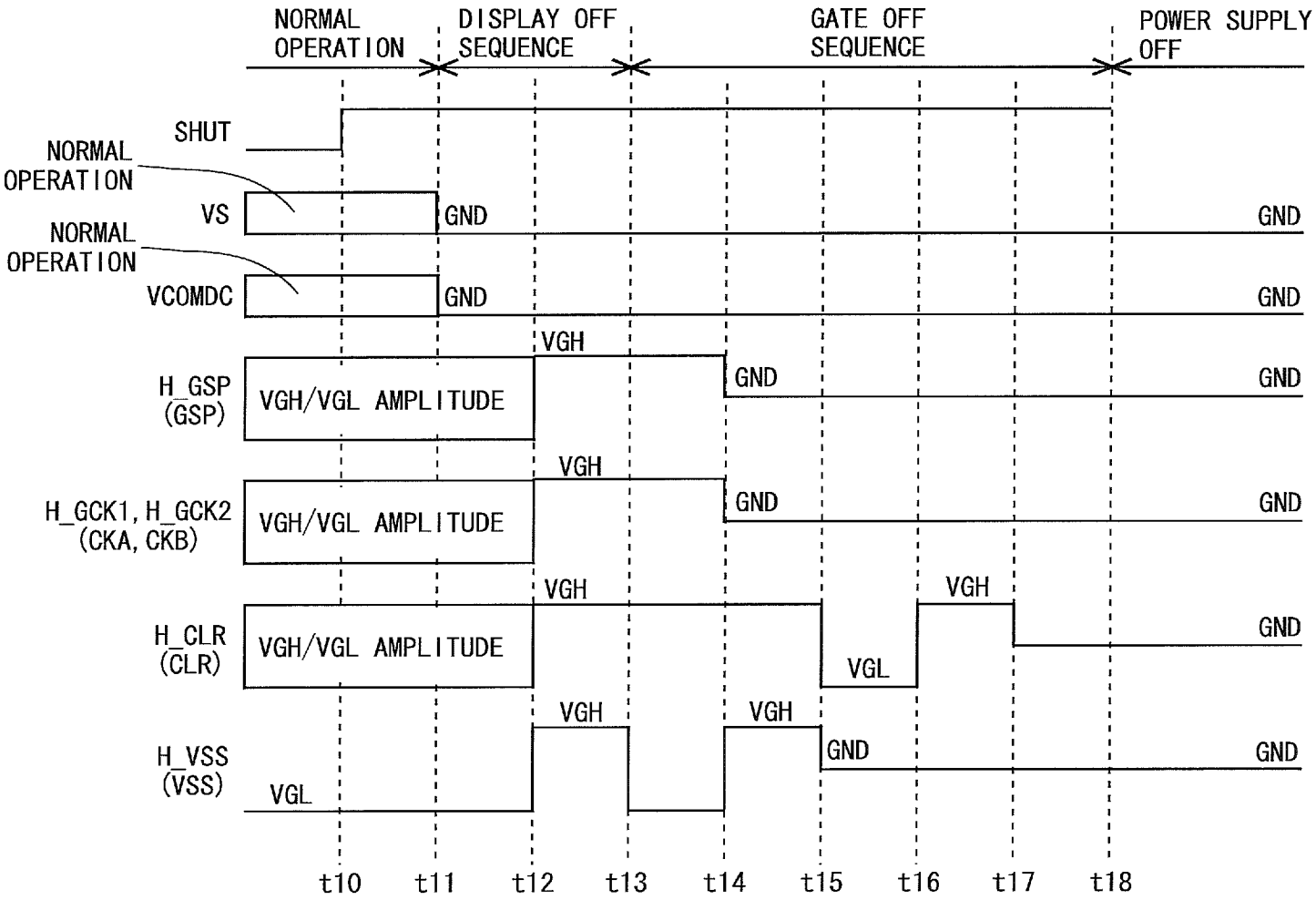
FIG. 11 is a signal waveform diagram for explaining another modification of the first embodiment concerning a display off sequence.

Concerning the display off sequence, in the first embodiment, with the gate start pulse signal H_GSP, the gate clock signals (the first gate clock signal H_GCK1 and the second gate clock signal H_GCK2), and the clear signal H_CLR being set in the waveforms similar to those in the normal operation time, the video signal potential VS and the common electrode potential VCOMDC are set equal to the ground potential GND (0 V). However, the present invention is not limited to the above. For example, the configuration may be such that, during the period from the time point t12 to the time point t13, with the gate clock signals (the first gate clock signal H_GCK1 and the second gate clock signal H_GCK2) and the reference potential H_VSS being set to the gate-on potential VGH, and the gate start pulse signal H_GSP and the clear signal H_CLR being set to the gate-off potential VGL, the video signal potential VS and the common electrode potential VCOMDC are set to the ground potential GND, as shown in FIG. 10. In this case, because the reference potential VSS is increased to the gate-on potential VGH with the thin film transistor TD being ON state, a potential of each gate bus line becomes the gate-on potential VGH, and a charge is discharged in each pixel formation portion. Further, for example, the configuration may be such that, during the period from the time point t12 to the time point t13, with the gate start pulse signal H_GSP, the gate clock signals (the first gate clock signal H_GCK1 and the second gate clock signal H_GCK2), the clear signal H_CLR, and the reference potential H_VSS being set to the gate-on potential VGH, the video signal potential VS and the common electrode potential VCOMDC are set to the ground potential GND, as shown in FIG. 11. In this case, because the reference potential VSS is increased to the gate-on potential VGH with the thin film transistor TD being ON state, and further because a potential of the first clock CKA is increased to the gate-on potential VGH with the thin film transistor TI becoming ON state by the netA becoming at the high level, a potential of each gate bus line becomes the gate-on potential VGH, and a charge is discharged in each pixel formation portion.

<1. 6. 2 Countermeasure to the Lead-in Voltage>

Figure 12:
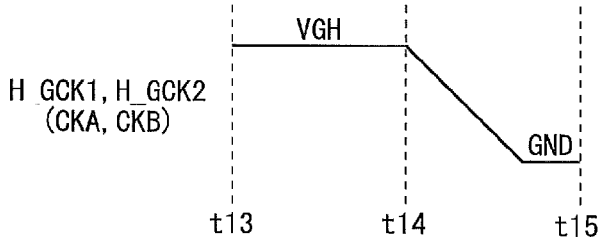
FIG. 12 is a signal waveform diagram for explaining a method of suppressing the influence of the lead-in voltage in the modification of the first embodiment.

In the first embodiment, in the gate-bus-line discharge step (t14 in FIG. 1) of the gate off sequence, the gate clock signals (the first gate clock signal H_GCK1 and the second gate clock signal H_GCK2) change from the gate-on potential VGH to the ground potential GND. Accordingly, because a potential of the first clock CKA quickly decreases in each bistable circuit, a potential of the gate bus line also quickly decreases. Therefore, reduction of the pixel electrode potential in each pixel formation portion due to the influence of what is called the lead-in voltage is a concern. When a pixel electrode potential decreases, even when a charge in the pixel formation portion is discharged in the display off sequence, a residual charge is accumulated in the pixel formation portion, as a result. Therefore, at the gate-bus-line discharge step, the potentials of the gate clock signals (the first gate clock signal H_GCK1 and the second gate clock signal H_GCK2) may be set to gently change (decrease) as shown in FIG. 12. Accordingly, influences of the lead-in voltage due to potential reduction of the gate bus line after the display off sequence are suppressed.

<1. 6. 3 Configuration of the Vicinity of the Level Shifter Circuit>

Figure 13:
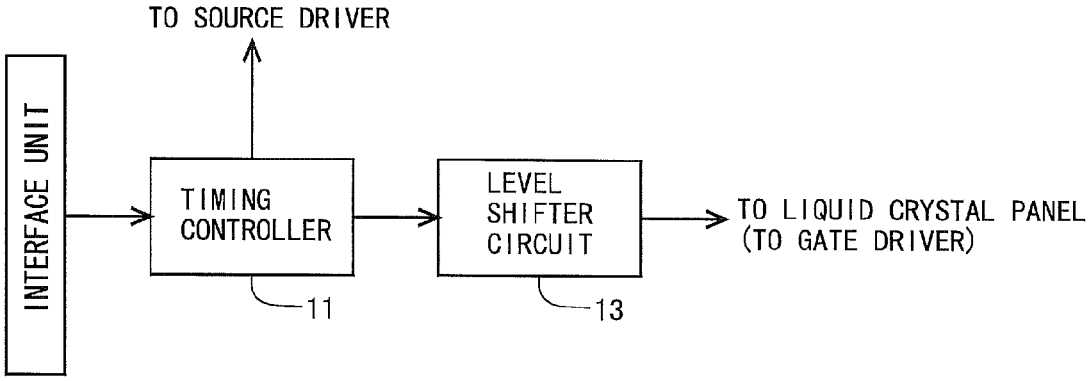
FIG. 13 is a schematic block diagram of a configuration of the vicinity of the level shifter circuit in the first embodiment.
Figure 14:
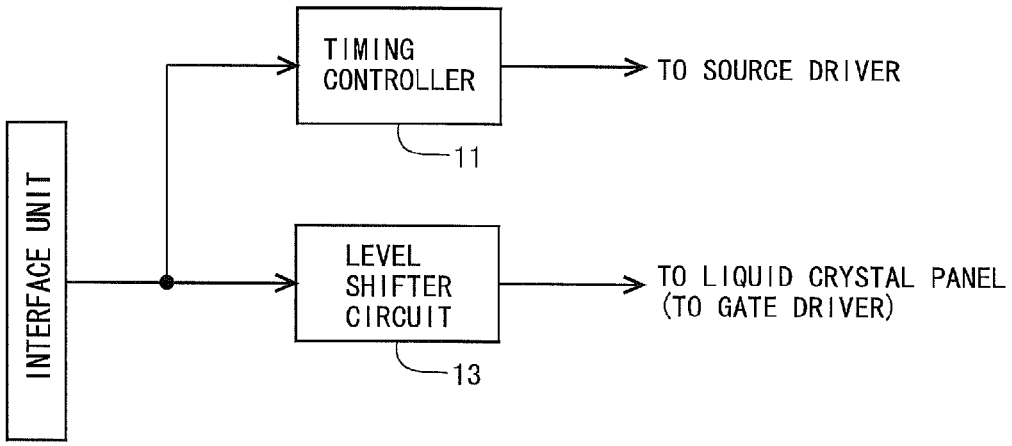
FIG. 14 is a schematic block diagram of a configuration of the vicinity of the level shifter circuit in the modification of the first embodiment.

Concerning a configuration of the vicinity of the level shifter circuit (see FIG. 2), the configuration as schematically shown in FIG. 13 is employed in the first embodiment. That is, the configuration is such that the gate start pulse signal and the gate clock signal are generated in the timing controller 11 based on the synchronization signal transmitted from outside. However, the present invention is not limited to the above. For example, in a configuration as shown in FIG. 14, the level shifter circuit 13 may be configured to generate the gate start pulse signal and the gate clock signal based on the synchronization signal transmitted from outside.

<1. 6. 4 About the Gate Off Sequence>

In the first embodiment, the netB potential reduction step for setting a potential of the netB to the low level (−10 V) is provided as a first step of the gate off sequence. However, this step is not necessarily required to be provided.

2. Second Embodiment

A second embodiment of the present invention is described. It should be noted that only points different from those in the first embodiment are described in detail, and the description of points similar to those in the first embodiment is simplified.

<2. 1 Configuration>

Figure 15:
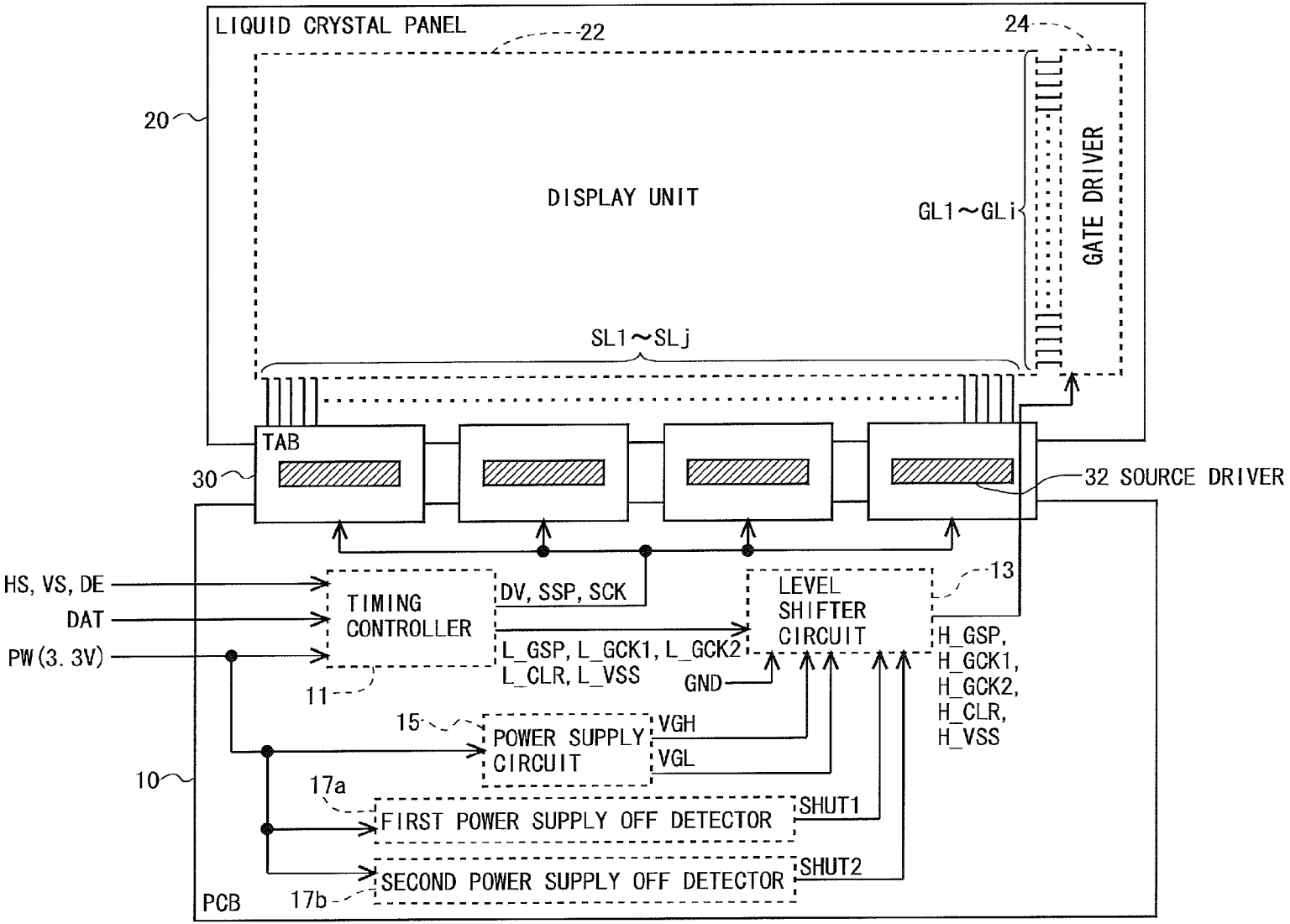
FIG. 15 is a block diagram showing an overall configuration of the active-matrix type liquid crystal display device according to the second embodiment of the present invention.

FIG. 15 is a block diagram showing an overall configuration of an active-matrix type liquid crystal display device according to the second embodiment of the present invention. The liquid crystal panel 20 and the TAB have configurations similar to those in the first embodiment. Concerning the PCB 10, although only one power supply off detector 17 is provided in the first embodiment, two power supply off detectors (a first power supply off detector 17*a* and a second power supply off detector 17*b*) are provided in the present embodiment. The first power supply off detector 17*a* sets a power supply state signal SHUT1 to the high level, when a voltage supplied from the power supply voltage PW becomes 2.4 V or below. The second power supply off detector 17*b* sets a power supply state signal SHUT2 to the high level, when a voltage supplied from the power supply voltage PW becomes 2.0 V or below. Further, although one signal L_GCK is transmitted from the timing controller 11 to the level shifter circuit 13 as a gate clock signal in the first embodiment, two signals (a first gate clock signal L_GCK1 and a second gate clock signal L_GCK2) are transmitted in the present embodiment. That is, in the present embodiment, a timing for the gate clock signal is not required to be generated anew by the level shifter circuit 13. Further, in the present embodiment, the clear signal L_CLR and the reference potential L_VSS are transmitted from the timing controller to the level shifter circuit 13. That is, in the present embodiment, timings for the clear signal and the reference potential are not required to be generated anew by the level shifter circuit 13.

Figure 16:
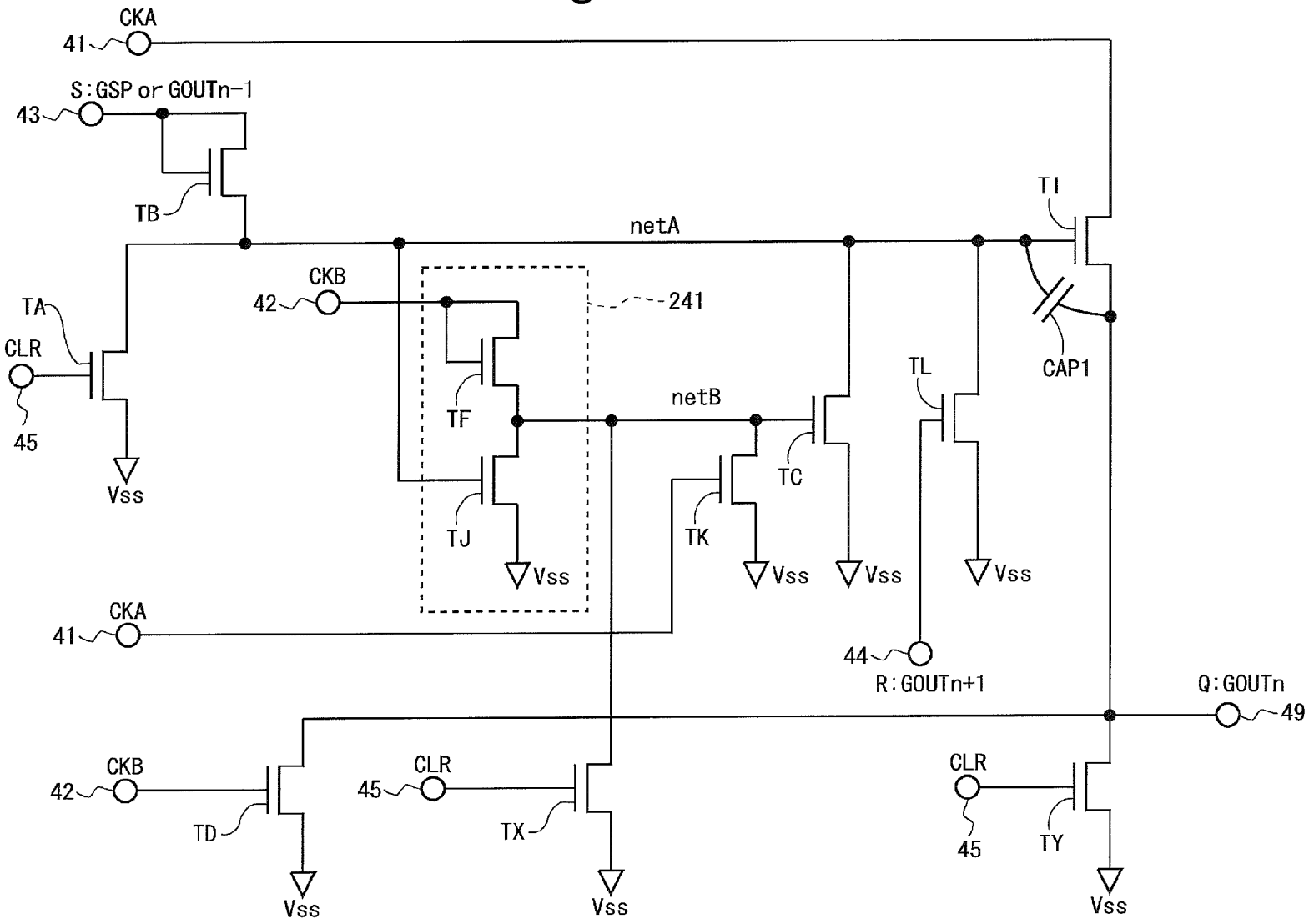
FIG. 16 is a circuit diagram showing a configuration of a bistable circuit included in a shift register in the second embodiment.

FIG. 16 is a circuit diagram showing a configuration of the bistable circuit in the present embodiment. In addition to configuration elements in the first embodiment shown in FIG. 8, two thin film transistors TX and TY are provided. Concerning the thin film transistor TX, the gate terminal is connected to an input terminal 45, the drain terminal is connected to the netB, and the source terminal is connected to the reference potential wiring. Concerning the thin film transistor TY, the gate terminal is connected to the input terminal 45, the drain terminal is connected to the output terminal 49, and the source terminal is connected to the reference potential wiring. It should be noted that, in the present embodiment, a second second-node control switching element is realized by the thin film transistor TX, and a second output-node control switching element is realized by the thin film transistor TY.

<2. 2 Operation when the Power Supply is Cut Off>

Figure 17:
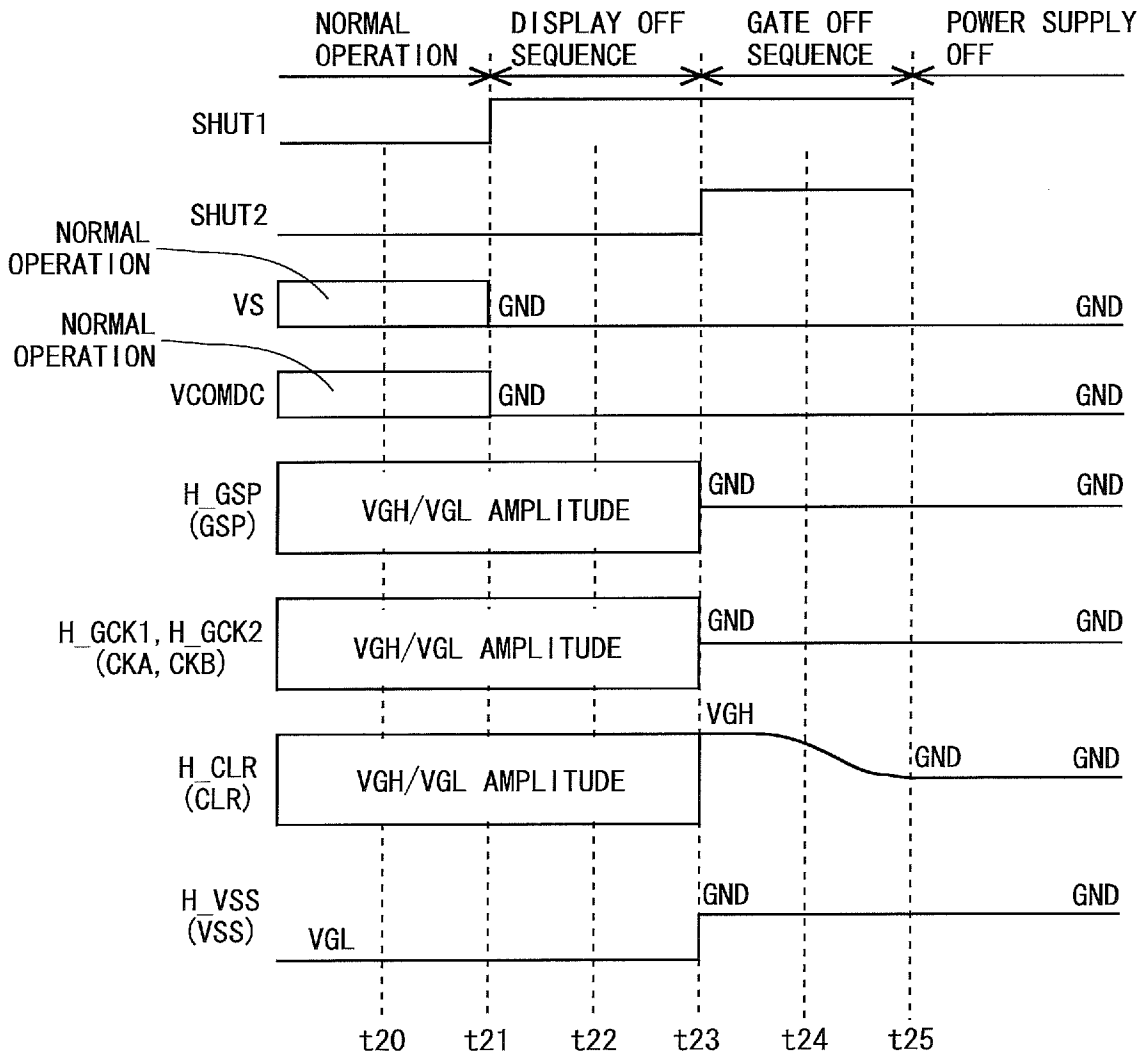
FIG. 17 is a signal waveform diagram for explaining the operation when the power supply is cut off in the second embodiment.

Next, the operation of the liquid crystal display device when supply of the power supply voltage PW from outside is cut off is described with reference to FIGS. 15 to 17. It should be noted that, in the present invention, it is assumed that the power supply voltage PW is normally supplied before a time point t20 and that the supply of the power supply voltage PW is cut off at the time point t20. The operation during the period when the power supply voltage PW is normally supplied (during the period before the time point t20) is similar to that in the first embodiment.

Supply of the power supply voltage PW is cut off at the time point t20. Thereafter, when a voltage supplied from the power supply voltage PW becomes 2.4 V or below (at a time point t21), the first power supply off detector 17*a* changes the power supply state signal SHUT1 from the low level to the high level. Accordingly, a period of the display off sequence starts. During this period, in a similar manner to that in the first embodiment, with the gate start pulse signal H_GSP, the gate clock signals (the first gate clock signal H_GCK1 and the second gate clock signal H_GCK2), and the clear signal H_CLR being set in the waveforms similar to those in the normal operation time, the video signal potential VS and the common electrode potential VCOMDC are set equal to the ground potential GND (0 V). Accordingly, by taking one vertical scanning period, a charge in the pixel formation portion in the display unit 22 is discharged.

Thereafter, when a voltage supplied from the power supply voltage PW becomes 2.0 V or below (at a time point t23), the second power supply off detector 17*b* changes the power supply state signal SHUT2 from the low level to the high level. Accordingly, a period of the gate off sequence starts. Then, the clear signal H_CLR is set to the gate-on potential VGH, and the gate start pulse signal H_GSP, the gate clock signals (the first gate clock signal H_GCK1 and the second gate clock signal H_GCK2), and the reference potential H_VSS are set to the ground potential GND. Accordingly, with the reference potential VSS being set to the ground potential GND, the thin film transistors TA, TX, and TY become in the ON state. Therefore, a potential of the netA, a potential of the netB, and a potential of the output terminal 49 become the ground potential GND. As a result, a charge on the netA, a charge on the netB, and a charge on the gate bus line are discharged. It should be noted that, concerning the clear signal H_CLR, because supply of the power supply voltage PW is cut off, the potential gradually decreases from the gate-on potential VGH to the ground potential GND.

Figure 18:
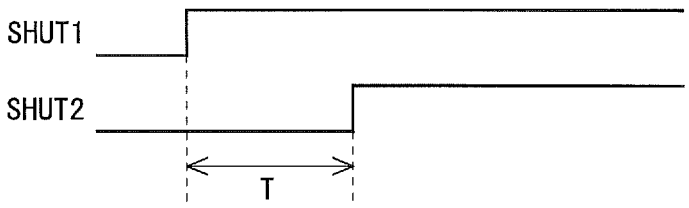
FIG. 18 is a signal waveform diagram for explaining the generation of a timing in the second embodiment.

In the present embodiment, the configuration is such that the two power supply off detectors are provided, and they change levels of the power supply state signals from the low level to the high level at mutually different voltage threshold values. Therefore, as shown in FIG. 18, for example, two timings having an interval of a period T can be generated. In the manner as described above, in the power supply off sequence, the two different processes (a process of the display off sequence and a process of the gate off sequence) are performed.

<2. 3 Effects>

According to the present embodiment, in the bistable circuit, there are provided the thin film transistor TA having the gate terminal connected to the input terminal 45 for the clear signal CLR, the source terminal connected to the reference potential wiring, and the drain terminal connected to the netA, the thin film transistor TX having the gate terminal connected to the input terminal 45 for the clear signal CLR, the source terminal connected to the reference potential wiring, and the drain terminal connected to the netB, and the thin film transistor TY having the gate terminal connected to the input terminal 45 for the clear signal CLR, the source terminal connected to the reference potential wiring, and the drain terminal connected to the output terminal 49. By such a configuration, when the clear signal CLR is set to the high level in the state that the ground potential GND is applied to the reference potential wiring, the thin film transistors TA, TX, and TY become in the ON state, and a potential of the netA, a potential of the netB, and a potential of the output terminal 49 become the ground potential GND. Therefore, after discharging a charge in the pixel formation portion, a potential on the netA, a potential on the netB, and a potential on the gate bus line can be quickly discharged in one step. In the manner as described above, a liquid crystal display device including an IGZO-GDM capable of quickly removing a residual charge in a panel when the power supply is turned off can be realized.

<2. 4 Modification>

Figure 19:
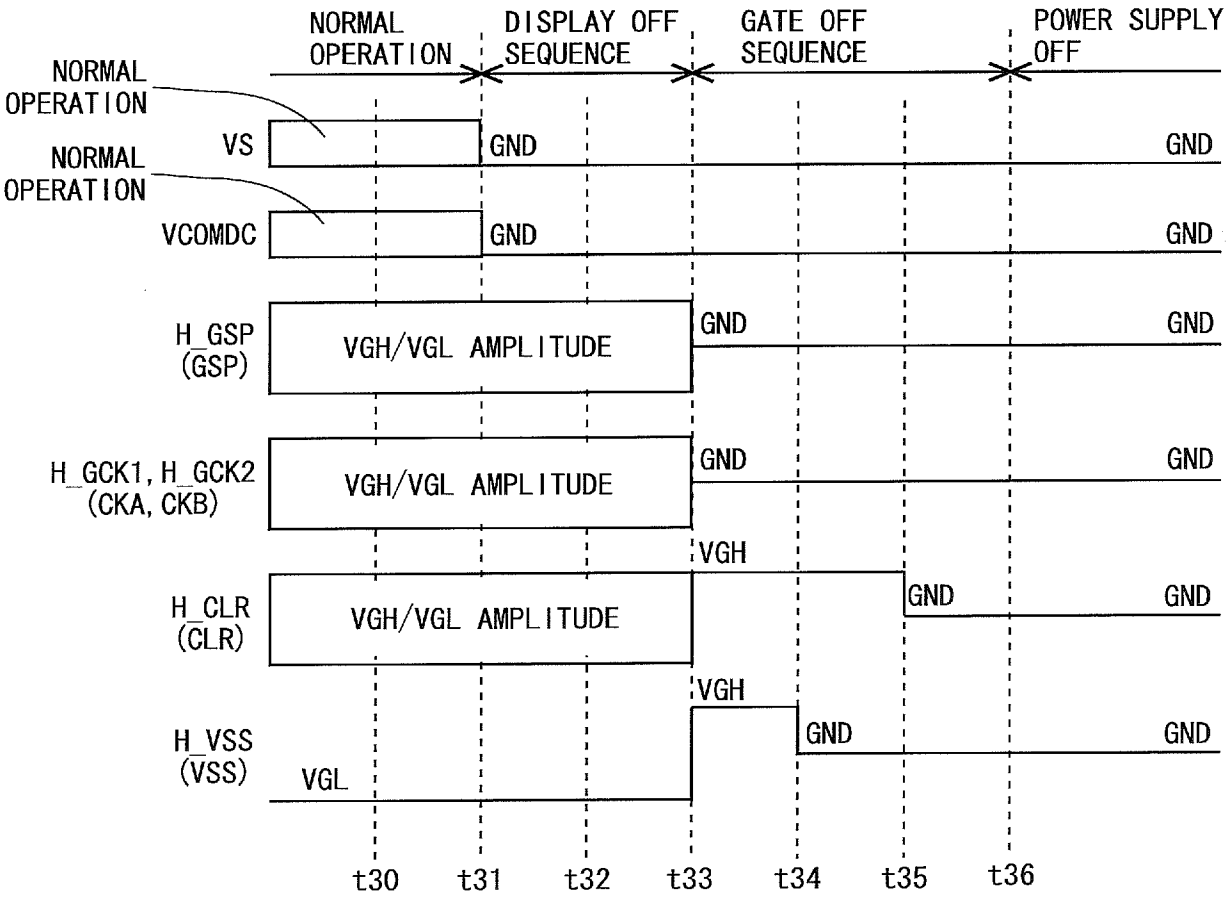
FIG. 19 is a signal waveform diagram for explaining the operation when the power supply is cut off in the modification of the second embodiment.

In the second embodiment, in the bistable circuit, the two thin film transistors TX and TY are provided in addition to the configuration elements of the first embodiment. However, the bistable circuit may be configured such that only one of the two thin film transistors TX and TY is provided. For example, in the case where the configuration is such that the thin film transistor TX is provided in addition to the configuration elements of the first embodiment, in the gate off sequence, as shown in FIG. 19, first, a process of discharging the charge on the gate bus line (see time points t33 to t34 in FIG. 19) is performed, and thereafter, a process of discharging the charge on the netB and the charge on the netA (see time points t34 to t35 in FIG. 19) is performed. As described above, first, a charge in a region where a thin film transistor for discharging a charge based on the clear signal CLR (as asynchronous reset signal) is not provided needs to be discharged, and thereafter, a charge in a region where a thin film transistor for discharging a charge based on the clear signal CLR is provided needs to be discharged. As for regions where a thin film transistor for discharging a charge based on the clear signal CLR is provided, a charge in each region may be sequentially discharged, or a charge in all regions may be discharged at the same timing like in the second embodiment.

It should be noted that, according to the present modification, the number of sequences increases as compared with the second embodiment. Therefore, it is necessary to obtain a start timing of each process either by increasing the number of the power supply off detectors or by setting the configuration of the level shifter circuit as shown in FIG. 4.

<3. Others>

Figure 20:
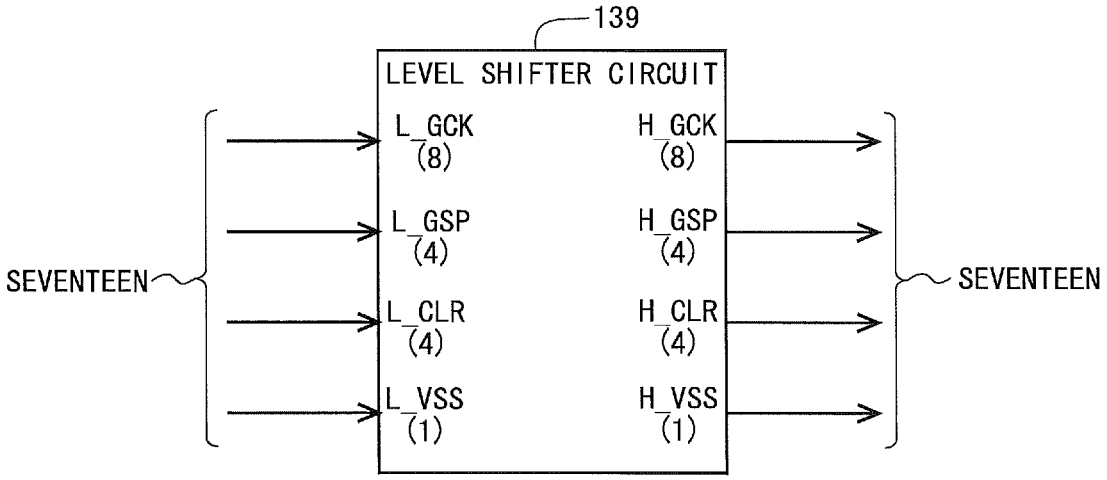
FIG. 20 is a diagram for explaining the input and output signals in the level shifter circuit of a conventional configuration.
Figure 21:
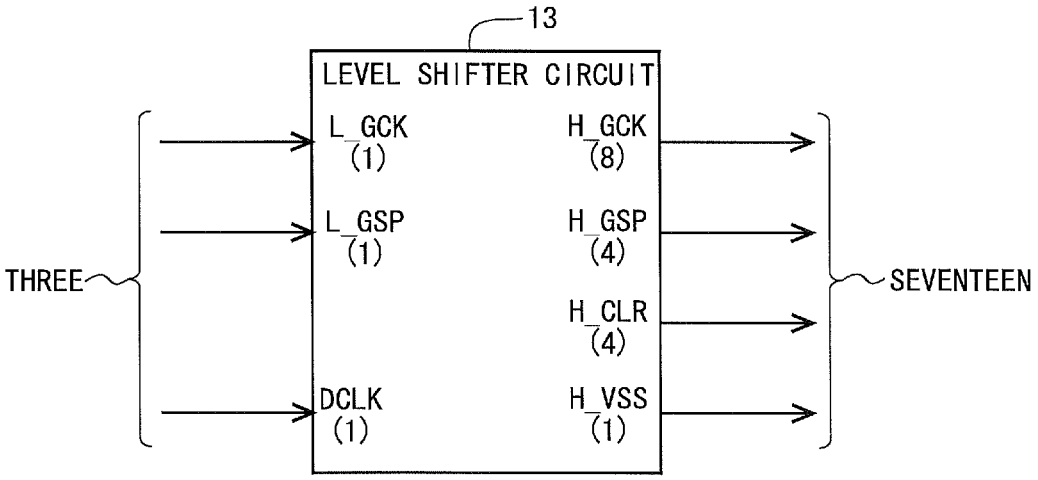
FIG. 21 is a diagram for explaining the input and output signals in the level shifter circuit that includes a timing generation logic unit.

In the IGZO-GDM, as can be understood from the above description of the embodiments, three values of the gate-on potential VGH (+20 V), the gate-off potential VGL (−10 V), and the ground potential GND (0 V) need to be output from the level shifter circuit 13, and also the power supply off sequence becomes complex and is configured by the plurality of steps. In recent years, in order to achieve low power consumption, there is often adopted a method called a "potential short" for temporarily setting an output of the source driver to a potential of a potential level with satisfactory power supply conversion efficiency, when the polarity of the video signal potential is inverted. The level shifter output also needs to be a three-value output (or a four-value output), by allowing the output from the gate-off potential VGL to the gate-on potential VGH once via the ground potential GND, or by allowing the output from the gate-on potential VGH to the gate-off potential VGL once via the ground potential GND (or the input power supply potential). Further, employing a multiphase clock in the shift register is also promoted. Power consumption P obtained by the drive of a clock signal is expressed as P=fcv, where f represents a frequency of the clock signal, c represents a wiring capacity of clock wiring, and v represents an amplitude of the clock signal. For example, when the number of clock signals is increased to a double, although the number of clock wirings becomes a double as compared with the number of those before the increase of the clock signals, the frequency f and the wiring capacity c become a half, respectively. As a result, power consumption becomes a half as compared with that before the increase of the clock signals. As described above, power consumption can be reduced by setting the clock signals in a multiphase. Based on the above, the number of clock signals to be transmitted from the level shifter circuit 13 to the gate driver 24 is increased as compared with a conventional case. Concerning this fact, like in the first embodiment, it is preferable to configure the level shifter circuit 13 to be able to generate more output signals from a smaller number of input signals by including the timing generation logic unit 131 in the level shifter circuit 13. According to a level shifter circuit 139 of a conventional configuration, seventeen input signals are necessary to output seventeen output signals as shown in FIG. 20, for example. However, by including the timing generation logic unit 131 in the level shifter circuit 13, it becomes possible to output seventeen output signals based on three input signals (a reference character DCLK denotes a dot clock) as shown in FIG. 21. According to such a level shifter circuit 13, because the number of input signals can be decreased, cost reduction and small package become possible. Further, it becomes possible to realize a complex power supply off sequence relatively easily. Further, a three-value output becomes possible without increasing the number of input signals as compared with a conventional practice. Further, it becomes possible to employ a timing controller which is not corresponding to the GDM.

As other modifications, when the DCLK in FIG. 21 is not output from a Tcon (timing controller), there are considered a method of generating an output signal based on two signals L_GCK and L_GSP transmitted from the Tcon by generating a reference DCLK using an OSC (oscillator) in the level shifter circuit 13, and a method that the level shifter circuit 13 receives a differential clock signal of a Tcon output and then generates the DCLK.

Further, as other modification, in the case where a signal indicating the power supply OFF is input from a user-set side like in a portable telephone and a smart-phone liquid crystal module, there is considered a configuration obtained by deleting the power supply off detector 17 (or the first power supply off detector 17*a* and the second power supply off detector 17*b*) from the configuration of each of the above embodiments.

In the above embodiments, the display off sequence and the gate off sequence are described as sequences upon supply of the power supply voltage PW from outside being cut off. However, the display off sequence and the gate off sequence can be also suitably implemented as a sequence of discharge when a mode of the display device shifts (when a mode shifts between a display mode and a sleep mode), or a sequence of discharge by a command input, for example.

DESCRIPTION OF REFERENCE CHARACTERS

11: TIMING CONTROLLER
13: LEVEL SHIFTER CIRCUIT
15: POWER SUPPLY CIRCUIT
17: POWER SUPPLY OFF DETECTOR
20: LIQUID CRYSTAL PANEL
22: DISPLAY UNIT
24: GATE DRIVER (SCANNING SIGNAL LINE DRIVE CIRCUIT)
32: SOURCE DRIVER (VIDEO SIGNAL LINE DRIVE CIRCUIT)
131: TIMING GENERATION LOGIC UNIT
132: OSCILLATOR
220: THIN FILM TRANSISTOR (IN PIXEL FORMATION PORTION)
240: SHIFT REGISTER
PW: POWER SUPPLY VOLTAGE
SHUT: POWER SUPPLY STATE SIGNAL
VGH: GATE-ON POTENTIAL
VGL: GATE-OFF POTENTIAL
L_GCK: GATE CLOCK SIGNAL
H_GCK1: FIRST GATE CLOCK SIGNAL
H_GCK2: SECOND GATE CLOCK SIGNAL
L_GSP, H_GSP: GATE START PULSE SIGNAL
L_CLR, H_CLR, CLR: CLEAR SIGNAL
L_VSS, H_VSS, VSS: REFERENCE POTENTIAL
TA, TB, TC, TD, TF, TI, TJ, TK, TL, TX, TY: THIN-FILM TRANSISTOR (IN BISTABLE CIRCUIT)
CKA: FIRST CLOCK
CKB: SECOND CLOCK
S: SET SIGNAL
R: RESET SIGNAL
Q: STATE SIGNAL

The invention claimed is:

1. A liquid crystal display device comprising: a substrate configuring a display panel; and a plurality of switching elements formed on the substrate, in which an oxide semiconductor is used as a semiconductor layer configuring the plurality of switching elements, the liquid crystal display device comprising:

a plurality of video signal lines for transmitting a video signal;

a plurality of scanning signal lines that intersect with the plurality of video signal lines;

a plurality of pixel formation portions arranged in a matrix shape corresponding to the plurality of video signal lines and the plurality of scanning signal lines;

a scanning signal line drive circuit that includes a shift register formed of a plurality of bistable circuits that sequentially output pulses based on a clock signal, and selectively drives the plurality of scanning signal lines based on the pulses output from the shift register, the plurality of bistable circuits being provided in one-to-one correspondence with the plurality of scanning signal lines;

a power supply state detector that detects ON/OFF states of power supply provided from outside; and a drive controller that outputs the clock signal, a reference potential as a potential which becomes a reference of operations of the plurality of bistable circuits, and a clear signal for initializing states of the plurality of bistable circuits, and controls an operation of the scanning signal line drive circuit, wherein the plurality of video signal lines, the plurality of scanning signal lines, the plurality of pixel formation portions, and the scanning signal line drive circuit are formed on the substrate, each of the plurality of bistable circuits has an output-node connected to the scanning signal line, an output-node control switching element having a first electrode to which the clock signal is applied, a second electrode connected to the output-node, and a third electrode to which the reference potential is applied, an output control switching element having a second electrode to which the clock signal is applied, and a third electrode connected to the output-node, a first-node connected to a first electrode of the output control switching element, a first first-node control switching element having a second electrode connected to the first-node, and a third electrode to which the reference potential is applied, a second first-node control switching element having a first electrode to which the clear signal is applied, a second electrode connected to the first-node, and a third electrode to which the reference potential is applied, a second-node connected to a first electrode of the first first-node control switching element, and a first second-node control switching element having a first electrode to which the clock signal is applied, a second electrode connected to the second-node, and a third electrode to which the reference potential is applied, the power supply state detector applies a predetermined power supply off signal to the drive controller when the power supply state detector detects an OFF state of the power supply, and when the drive controller receives the power supply off signal, the drive controller controls an operation of the scanning signal line drive circuit so that a first discharge process of discharging a charge in the pixel formation portion is performed and thereafter controls an operation of the scanning signal line drive circuit so that a second discharge process of discharging a charge on the scanning signal line, a charge of the second-node, and a charge of the first-node is performed.

2. The liquid crystal display device according to claim 1, wherein the second discharge process includes a scanning signal line discharge process of discharging a charge on the scanning signal line, a first-node discharge process of discharging a charge of the first-node, and a second-node discharge process of discharging a charge of the second-node, the drive controller controls an operation of the scanning signal line drive circuit so as to perform a process in an order of the scanning signal line discharge process, the second-node discharge process, and the first-node discharge process, the drive controller sets the clock signal to a ground potential and sets the clear signal and the reference potential to a high level, in the scanning signal line discharge process, the drive controller sets the clear signal to a low level and sets the clock signal and the reference potential to a ground potential, in the second-node discharge process, and the drive controller sets the clear signal to a high level and sets the clock signal and the reference potential to a ground potential, in the first-node discharge process.

3. The liquid crystal display device according to claim 2, wherein the drive controller gradually changes the clock signal from a high level to a low level, in the scanning signal line discharge process.

4. The liquid crystal display device according to claim 1, wherein each of the plurality of bistable circuits further has a second second-node control switching element having a first electrode to which the clear signal is applied, a second electrode connected to the second-node, and a third electrode to which the reference potential is applied, and a second output-node control switching element having a first electrode to which the clear signal is applied, a second electrode connected to the output-node, and a third electrode to which the reference potential is applied, and the drive controller sets the clear signal to a high level and sets the clock signal and the reference potential to a ground potential, in the second discharge process.

5. The liquid crystal display device according to claim 1, wherein each of the plurality of bistable circuits further has a second second-node control switching element having a first electrode to which the clear signal is applied, a second electrode connected to the second-node, and a third electrode to which the reference potential is applied, and the drive controller controls an operation of the scanning signal line drive circuit so that a process of discharging a charge of the second-node and a charge of the first-node is performed after a process of discharging a charge on the scanning signal line is performed, in the second discharge process.

6. The liquid crystal display device according to claim 1, wherein each of the plurality of bistable circuits further has a second output-node control switching element having a first electrode to which the clear signal is applied, a second electrode connected to the output-node, and a third electrode to which the reference potential is applied, and the drive controller controls an operation of the scanning signal line drive circuit so that a process of discharging a charge on the scanning signal line and a charge of the first-node is performed after a process of discharging a charge of the second-node is performed, in the second discharge process.

7. The liquid crystal display device according to claim 1, wherein the drive controller includes a level shifter circuit that converts a signal of a low voltage into a signal of a high voltage, and the level shifter circuit includes a logic circuit unit for generating, from one clock signal, a plurality of clock signals having mutually different phases.

8. The liquid crystal display device according to claim 1, wherein the drive controller includes a level shifter circuit that converts a signal of a low voltage into a signal of a high voltage, the level shifter circuit is connected to a timing controller by two or more signal lines, and signals transmitted by two signal lines out of the signal lines that connect between the level shifter circuit and the timing controller are a signal by which horizontal synchronization can be detected and a signal by which vertical synchronization can be detected.

9. The liquid crystal display device according to claim 7, wherein the level shifter circuit further includes an oscillation circuit unit that outputs a basic clock, and the logic circuit unit generates the plurality of clock signals, based on the basic clock that is output from the oscillation circuit unit.

10. The liquid crystal display device according to claim 7, wherein the level shifter circuit further includes an oscillation circuit unit that outputs a basic clock, and a nonvolatile memory for generating a timing of the logic circuit unit is stored in a package IC that includes a level shifter circuit.

11. A driving method of a liquid crystal display device comprising: a substrate configuring a display panel; a plurality of switching elements formed on the substrate; a plurality of video signal lines for transmitting video signals; a plurality of scanning signal lines intersecting with the plurality of video signal lines; a plurality of pixel formation portions arranged in a matrix shape corresponding to the plurality of video signal lines and the plurality of scanning signal lines; a scanning signal line drive circuit for driving the plurality of scanning signal lines; and a drive controller for controlling an operation of the scanning signal line drive circuit, in which an oxide semiconductor is used as a semiconductor layer configuring the plurality of switching elements, wherein the driving method comprises:

a power supply state detecting step of detecting ON/OFF states of power supply provided from outside; and a charge discharging step of discharging a charge in the display panel, the plurality of video signal lines, the plurality of scanning signal lines, the plurality of pixel formation portions, and the scanning signal line drive circuit are formed on the substrate, the scanning signal line drive circuit includes a shift register formed of a plurality of bistable circuits which are provided in one-to-one correspondence with the plurality of scanning signal lines, the plurality of bistable circuits sequentially outputting pulses based on a clock signal, the drive controller outputs the clock signal, a reference potential as a potential that becomes a reference of operations of the plurality of bistable circuits, and a clear signal for initializing states of the plurality of bistable circuits, each of the plurality of bistable circuits has an output-node connected to the scanning signal line, an output-node control switching element having a first electrode to which the clock signal is applied, a second electrode connected to the output-node, and a third electrode to which the reference potential is applied, an output control switching element having a second electrode to which the clock signal is applied, and a third electrode connected to the output-node, a first-node connected to a first electrode of the output control switching element, a first first-node control switching element having a second electrode connected to the first-node, and a third electrode to which the reference potential is applied, a second first-node control switching element having a first electrode to which the clear signal is applied, a second electrode connected to the first-node, and a third electrode to which the reference potential is applied, a second-node connected to a first electrode of the first first-node control switching element, and a first second-node control switching element having a first electrode to which the clock signal is applied, a second electrode connected to the second-node, and a third electrode to which the reference potential is applied, the charge discharging step includes a first discharge step of discharging a charge in the pixel formation portion, and a second discharge step of discharging a charge on the scanning signal line, a charge of the second-node, and a charge of the first-node, and the charge discharging step is executed when the OFF state of the power supply is detected in the power supply state detecting step.

12. The driving method of a liquid crystal display device according to claim 11, wherein the second discharge step includes a scanning-signal-line discharge step of discharging a charge on the scanning signal line, a first-node discharge step of discharging a charge of the first-node, and a second-node discharge step of discharging a charge of the second-node, the drive controller controls an operation of the scanning signal line drive circuit so as to perform a process in an order of the scanning-signal-line discharge step, the second-node discharge step, and the first-node discharge step, in the scanning-signal-line discharge step, the clock signal is set to a ground potential, and the clear signal and the reference potential are set to a high level, in the second-node discharge step, the clear signal is set to a low level, and the clock signal and the reference potential are set to a ground potential, and in the first-node discharge step, the clear signal is set to a high level, and the clock signal and the reference potential are set to a ground potential.

13. The driving method of a liquid crystal display device according to claim 12, wherein in the scanning-signal-line discharge step, the clock signal gradually changes from a high level to a low level.

14. The driving method of a liquid crystal display device according to claim 11, wherein each of the plurality of bistable circuits further has a second second-node control switching element having a first electrode to which the clear signal is applied, a second electrode connected to the second-node, and a third electrode to which the reference potential is applied, and a second output-node control switching element having a first electrode to which the clear signal is applied, a second electrode connected to the output-node, and a third electrode to which the reference potential is applied, and in the second discharge step, the clear signal is set to a high level, and the clock signal and the reference potential are set to a ground potential.

15. The driving method of a liquid crystal display device according to claim 11, wherein each of the plurality of bistable circuits further has a second second-node control switching element having a first electrode to which the clear signal is applied, a second electrode connected to the second-node, and a third electrode to which the reference potential is applied, and in the second discharge step, after a process of discharging a charge on the scanning signal line is performed, a process of discharging a charge of the second-node and a charge of the first-node is performed.

16. The driving method of a liquid crystal display device according to claim 11, wherein each of the plurality of bistable circuits further has a second output-node control switching element having a first electrode to which the clear signal is applied, a second electrode connected to the output-node, and a third electrode to which the reference potential is applied, and in the second discharge step, after a process of discharging a charge of the second-node is performed, a process of discharging a charge on the scanning signal line and a charge of the first-node is performed.

* * * * *